US008508415B2

(12) United States Patent
Ikegaya et al.

(10) Patent No.: US 8,508,415 B2
(45) Date of Patent: Aug. 13, 2013

(54) ANTENNA AND ELECTRIC DEVICE HAVING THE SAME

(75) Inventors: Morihiko Ikegaya, Kasumigaura (JP); Haruyuki Watanabe, Hitachi (JP); Naoki Iso, Hitachi (JP); Tomoyuki Ogawa, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 628 days.

(21) Appl. No.: 12/659,764

(22) Filed: Mar. 19, 2010

(65) Prior Publication Data

US 2010/0176997 A1 Jul. 15, 2010

(51) Int. Cl.
*H01Q 1/24* (2006.01)

(52) U.S. Cl.
USPC ..... 343/702

(58) Field of Classification Search
USPC ..... 343/702, 700 MS, 767
See application file for complete search history.

(56) References Cited

U.S. PATENT DOCUMENTS

| | | | | |
|---|---|---|---|---|
| 6,292,153 | B1 * | 9/2001 | Aiello et al. | 343/767 |
| 6,864,848 | B2 * | 3/2005 | Sievenpiper | 343/767 |
| 7,397,439 | B2 * | 7/2008 | Kanno et al. | 343/767 |
| 7,619,578 | B2 * | 11/2009 | Kanno | 343/767 |
| 2003/0117329 | A1 * | 6/2003 | Saegrov et al. | 343/741 |
| 2005/0275539 | A1 * | 12/2005 | Sakama et al. | 340/572.7 |
| 2008/0272972 | A1 | 11/2008 | Kanno et al. | |

FOREIGN PATENT DOCUMENTS

| | | | |
|---|---|---|---|
| JP | 57-35401 | A | 2/1982 |
| JP | 8-23224 | | 1/1996 |
| JP | 2009-81689 | A | 4/2009 |
| WO | WO 2007/138959 | A1 | 12/2007 |

OTHER PUBLICATIONS

Notification of Reason(s) for Refusal dated Nov. 22, 2011, with English translation.

* cited by examiner

*Primary Examiner* — Huedung Mancuso
(74) *Attorney, Agent, or Firm* — McGinn Intellectual Property Law Group, PLLC

(57) ABSTRACT

An antenna for transmitting and receiving an electric wave in plural frequency bands has a conductor, two slots formed in the conductor to be facing to each other, opened ends of the two slots being formed on opposite sides, respectively, and a feeding point formed only in either one of the two slots.

17 Claims, 21 Drawing Sheets

860 MHz 1920 MHz

ANTENNA AND ELECTRIC DEVICE HAVING THE SAME

The present application is based on Japanese Patent Application No. 2008-253668 filed on Sep. 30, 2008, the entire contents of which are incorporated herein by reference.

BACKGROUND OF THE INVENTION

1. Field of the Invention

The present invention relates to an antenna to be applied to a telecommunication system employing an electric wave comprising a particular polarization component, and more particularly, to an antenna and an electric device having the same, by which transmission and reception with improved electric wave efficiency for two frequency bands of this telecommunication system.

2. Related Art

Currently, there are a lot of telecommunication systems employing the electric wave comprising a particular polarization component (vertical polarization or horizontal polarization) such as mobile communication (e.g. mobile phone) and ground wave television broadcasting. Particularly, in the mobile communication, the electric wave comprising the vertical polarization is often used in view of influence of obstacles, communication distance and the like. Further, in accordance with increase in capacity of communication data amount, speedup of the communication, diversification of the communication system and the like, there is a tendency of using two or more different frequency bands even in the case that the communication form is analogous or similar for plural terminals such as the mobile phone communication.

When the antenna to be employed for the telecommunication system using the electric wave comprising a limited polarization component supports only one frequency band, its structure per se is often designed based on an element size which is not less than ¼ times of a wavelength of the electric wave of the frequency band used in the telecommunication system. Further, when a single antenna supports the different two frequency bands, its antenna is designed based on the element size which is not less than ¼ of the wavelength of each frequency band, more particularly, not less than ¼ of the wavelength of the electric wave of the wavelength at a low frequency band side. In addition, the antenna is designed for using a high-order harmonic wave component of the low frequency band side in some cases. However, when this element size cannot be held by the reason of e.g. downsizing of the electric device carrying the antenna, it is extremely difficult to satisfy enough transmission and reception characteristics unless a complex structure using together a wavelength-shortening effect of a dielectric material and an electric circuit element and the like.

So as to solve the above problem, Japanese Patent Laid-Open No. 8-23224 (JP-A 8-23224) discloses a representative example of antennas in which a transmission and reception characteristic of the electric wave comprising a particular polarized wave is improved by a simpler structure. The antenna as disclosed in JP-A 8-23224 comprises a structure corresponding to one using frequency band. Since a technique of feeding an electric power to two slot parts is realized by a branched feeding line. It is sufficiently assumed that the single body can apply to the different two frequency bands according to the structure of the slot part. In other words, such a structure comprises two slot parts which mainly transmit and receive a vertical polarization wave and are disposed horizontally with respect to the earth and opposed to each other, and lateral lengths of the two slot parts are different from each other to correspond to the different two frequency bands. According to this structure, it is contemplated that it is possible to realize an antenna by which the transmission and reception of the electric wave comprising the particular polarization in the different two frequency bands with high efficiency can be achieved in the single device with the simpler structure. However, for this case, it is assumed that an enough size of a conductor part provided between the both slots (i.e. an interval between the slots) is required such that each of the two slot parts operates usefully for the different two frequency bands. Therefore, the dimensions of the antenna is required to be equal to or greater than a sum of the lengths of the two slot parts having the different lateral lengths and a length of the conductor part provided between the two slot parts. Accordingly, it is difficult to downsize the antenna. Further, in accordance with the increase in the antenna size, it is necessary to consider a length of each feeding line extending from a branching part of the feeding line to each slot part and an installation location of the feeding line. As a result, the structure of the antenna is complicated, and it is very likely that design of the device becomes difficult finally.

As described above, it is difficult to realize an antenna, by which the transmission and reception of the electric wave comprising the particular polarization component in the different two frequency bands with high efficiency can be achieved in the single device by a small sized antenna with the simpler structure.

SUMMARY OF THE INVENTION

Accordingly, an object of the present invention is to provide a small sized antenna and an electric device having the same, by which the transmission and reception of the electric wave comprising the particular polarization in the different two frequency bands with high efficiency can be achieved in the single device with the simpler structure.

According to a feature of the invention, an antenna for transmitting and receiving an electric wave in plural frequency bands, comprises:

a conductor;

two slots formed in the conductor to be facing to each other, opened ends of the two slots being formed on opposite sides, respectively; and a feeding point formed only in either one of the two slots.

In the antenna, respective areas of the two slots may be different from each other.

In the antenna, a length of the conductor provided between the two slots is preferably shorter than a length of each of the two slots.

In the antenna, the two slots may be line-symmetrical with respect to a line passing through the two slots as a symmetrical axis.

In the antenna, at least one of the two slots may comprise a rectangular slot.

In the antenna, at least one of the two slots may comprise a polygonal slot having at least two different widths along a longitudinal direction of the polygonal slot.

In the antenna, the feeding point may be formed in vicinity of a portion in which the width of the polygonal slot is changed.

In the antenna, the two slots may have the same width at a portion in which the two slots are facing to each other.

In the antenna, at least one of the two slots may comprise a fan-shaped slot having a width which is slowly changed along a longitudinal direction of the fan-shaped slot.

In the antenna, at least one of the two slots may comprise a complex type slot having a fan-shaped slot having a width which is slowly changed along a longitudinal direction of the complex type slot, a parallel slot connected to the fan-shaped slot and having a width which is constant along the longitudinal direction of the complex type slot, and two triangular slots connected to the parallel slot and each of which has a triangular shape.

In the antenna, the two slots may be formed to sandwich a part of another of the two slots.

In the antenna, the antenna may be bent at two straight lines parallel with the symmetrical axis as two folding lines.

In the antenna, the two folding lines may be equidistant from the symmetrical axis.

According to another feature of the invention, an electric device comprises:

a casing; and an antenna formed for transmitting and receiving an electric wave in plural frequency bands, formed in the casing, the antenna comprising:

a conductor;

two slots formed in the conductor to be facing to each other, opened ends of the two slots being formed on opposite sides, respectively; and a feeding point formed only in either one of the two slots.

Points of the Invention

In the antenna of the present invention, two antenna element structures by which the transmission and reception of the electric wave comprising the particular polarization component are used, and the feeding point is provided in only one of the two antenna element structures. In the antenna of the present invention, resonant characteristics in different two frequency bands can be adjusted by adjusting the dimensions of the respective antenna element structures, adjusting a location of the feeding point, or adjusting both of the antenna element structure dimensions and the feeding point location. Therefore, according to the antenna of the present invention, it is possible to transmit and receive the electric wave comprising the particular polarization component in the two frequency bands different from each other with high efficiency by the single device with the simpler structure.

In the antenna of the present invention, even when the antenna is built-in in a casing of an electric device or installed in an equipment using metal (conductor), the electric wave transmission and reception characteristics of the antenna element is not adversely affected, unless the metal (conductor) part such as casing or equipment approaches or contacts a part contributing to the electric power radiation or a part for adjusting the resonance characteristics of the two antenna element structures. Therefore, the selection of the antenna location can be facilitated.

The feeding line employed in the antenna of the present invention does not adversely affect the electric wave transmission and reception characteristics of the antenna element as long as the feeding line is provided at a position not to intersect a non-conductor region (slot) of each of the two antenna elements. According to this structure, since a direction of installing the feeding line can be freely selected, when the antenna of the present invention is built-in in the casing of the electric device or installed in the equipment, arrangement of the feeding line can be facilitated.

As a result, the present invention provides following excellent effects.

(1) It is possible to realize the antenna, by which the transmission and reception of the electric wave comprising the particular polarization in the different two frequency bands with high efficiency can be achieved with the simpler structure.

(2) It is possible to realize the antenna, in which a degree of freedom of an installation condition is high.

BRIEF DESCRIPTION OF THE DRAWINGS

The embodiments according to the invention will be explained below referring to the drawings, wherein.

DETAILED DESCRIPTION OF THE EMBODIMENTS

Figure 1:
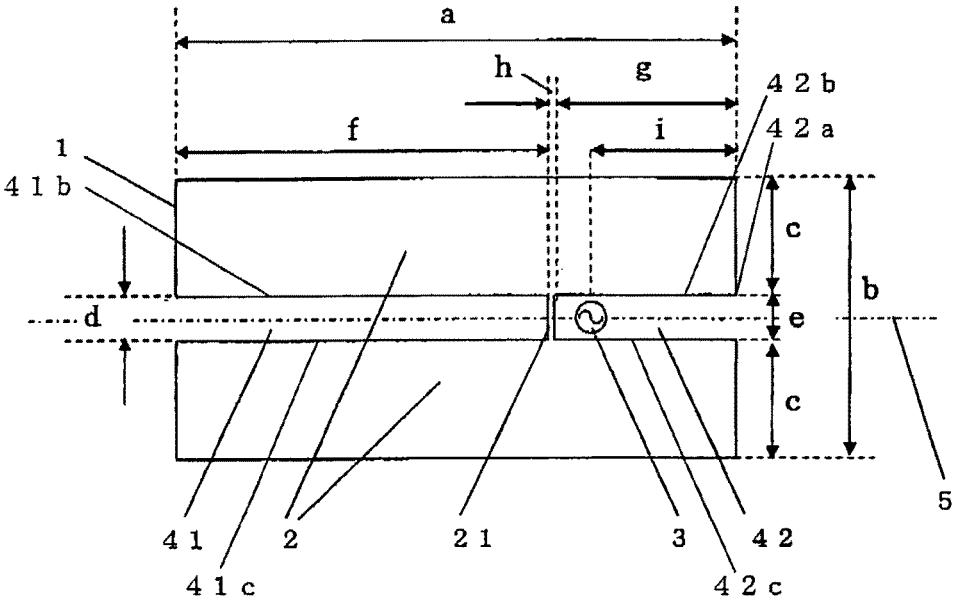
FIG. 1 is an explanatory diagram showing a structure of an antenna in the first embodiment according to the present invention.

Next, a connector in the embodiments according to the present invention will be explained below in more detail in conjunction with the appended drawings.

(General Structure of the Antenna)

The antenna of the present invention, two antenna element structures for transmitting and receiving an electric wave comprising a particular polarization component with high efficiency are employed, the respective two antenna element structures are provided to face to each other in the same plane of the antenna, and a feeding point is provided at only one of the two antenna element structures. In the antenna of the present invention, resonant characteristics in two frequency bands different from each other are adjusted by adjusting the dimensions of the respective antenna element structures, adjusting of the location of the feeding point, or adjusting both of the antenna element structure dimensions and the feeding point location, thereby transmitting and receiving the electric wave comprising the particular polarization in the two frequency bands different from each other with high efficiency by the single device with the simpler structure. Herein, the transmission and reception in the two frequency bands different from each other are not the transmission and reception of an electric wave in two frequency bands by utilizing a higher harmonic wave of one of the two frequency bands.

The electric wave comprising the particular polarization component is an electric wave comprising only one of a vertical polarization and a horizontal polarization in general terms. In addition, the antenna element structure as described above is based on a structure that has been generally known to be effective for the transmission and reception of the electric wave comprising the particular polarization component, and such a structure is applied to the present invention.

The antenna of the present invention may comprise a conductor plate or an elastic conductor sheet (film). As the conductor plate, a copper plate, a phosphor bronze plate with spring characteristics may be used. On the other hand, as the elastic conductor sheet, an aluminum foil may be used. In addition, the conductor part of the antenna may be covered with an insulative material. As a cable to be connected with the feeding point, a coaxial cable, a plurality of single line cables or a flat cable may be used.

The antenna of the present invention has a structure in which even when being built-in in a casing of an electric device or installed in an equipment using metal (conductor), the electric wave transmission and reception characteristics of the antenna element is not adversely affected, unless the metal (conductor) part such as the casing or the equipment approaches or contacts the part contributing to the electric power radiation or the part for adjusting the resonance characteristics of the two antenna element structures. The antenna of the present invention has a structure in which feeding line does not adversely affect the electric wave transmission and reception characteristics of the antenna element as long as the feeding line is installed at the position not to intersect the non-conductor region of each of the two antenna elements.

The antenna of the present invention can be built-in in the casing of the electric device or installed in the equipment. The antenna of the present invention can be fixed by means of a blocking tape. In addition, the fixing location of the antenna can be in an inner surface of the casing of the electric device, a surface of a dielectric material such as glass or plastic inside the casing, and the like.

The antenna of the present invention can be installed at a surface of a dielectric material such as a plastic material part of the casing of the electric device or a window glass.

Next, the antenna structure in the embodiment of the present invention, in which two antenna element structures which transmits and receives the electric wave comprising the particular polarization component are used, and the feeding point is provided in only one of the two antenna element structures, thereby realizing the transmission and reception of the electric wave in the two different frequency bands, will be explained below in conjunction with FIGS. 1 to 3.

First Embodiment

FIG. 1 is an explanatory diagram showing a structure of an antenna 1 in the first embodiment according to the present invention. FIG. 2 is an explanatory diagram showing an operation principle of the antenna 1 in the first embodiment according to the present invention. FIG. 3 is an explanatory diagram showing the operation principle of the antenna 1 in the first embodiment according to the present invention.

An antenna 1 is an antenna which transmits and receives electric waves in a plurality of frequency bands. Referring to FIG. 1, the antenna 1 comprises a conductor plate 2, two rectangular slots 41, 42 formed to face to the conductor plate 2, respective opened ends of which are formed on opposite sides, and a feeding point 3 formed in only one of the rectangular slots 41, 42.

More concretely, in the antenna 1, a first rectangular slot 41 having a width d and a length f, and a second rectangular slot 42 having a width e and a length g, each of which has the opened end in opposite directions with respect to a slot boundary conductor part 21 having a width h as a boundary are formed in the conductor plate 2 having a length a and width b. The antenna 1 has a line-symmetrical structure with respect to a boundary line 5 passing through a center of each width of the first and second rectangular slots 41, 42 (a center of top and bottom in a longitudinal direction of the slot boundary conductor part 21, i.e. a center in a vertical direction of FIG. 1) and a center of the width b of the conductor plate 2, as a symmetrical axis. Herein, the width h of the slot boundary conductor part 21 is formed to be shorter enough than the length f and the length g of the two rectangular slots 41, 42. When a first wavelength of an electric wave in a first designed frequency is defined as $\lambda 1$ and a second wavelength of an electric wave in a second designed frequency is defined as $\lambda 2$ in the two frequency bands to be used, the length f of the first rectangular slot 41 is set to be about $(\lambda 1)\times 3/16$, and the length g of the second rectangular slot 42 is set to be about $(\lambda 2)\times 3/16$. The feeding point 3 for supplying an electric power to the antenna 1 is provided in only one of the first and second rectangular slots 41, 42, herein, the first rectangular slot 42. The feeding point 3 is disposed to be distant by a distance i from the opened end 42*a* of the second rectangular slot 42. In addition, two operation frequency bands of the antenna 1 are determined by each dielectric material constituting the device casing or the equipment or arrangement of other conductor parts, when the antenna of the present invention is built-in the device casing, the equipment or the like. In addition, the two frequency bands are determined by a wavelength contraction effect caused by a dielectric constant particular to the material, when the antenna of the present invention is installed at a surface of each dielectric material.

Figure 2:
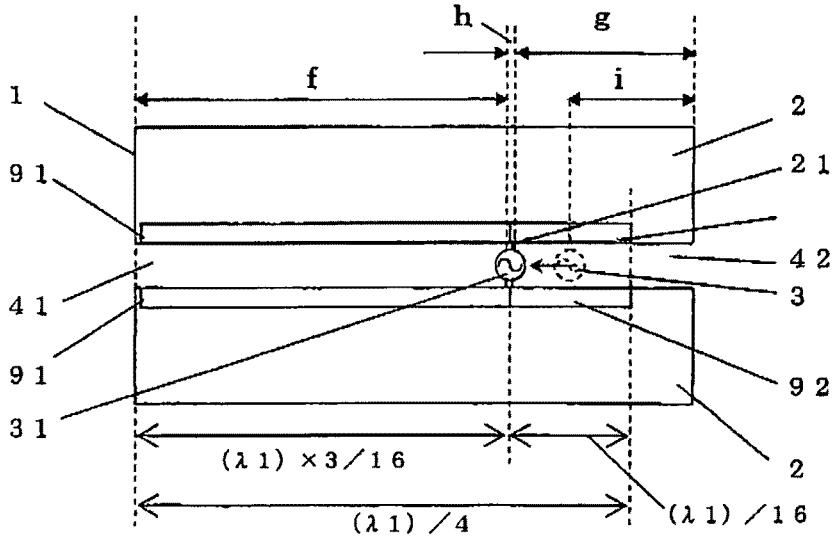
FIG. 2 is an explanatory diagram showing an operation principle of the antenna in the first embodiment according to the present invention.
Figure 3:
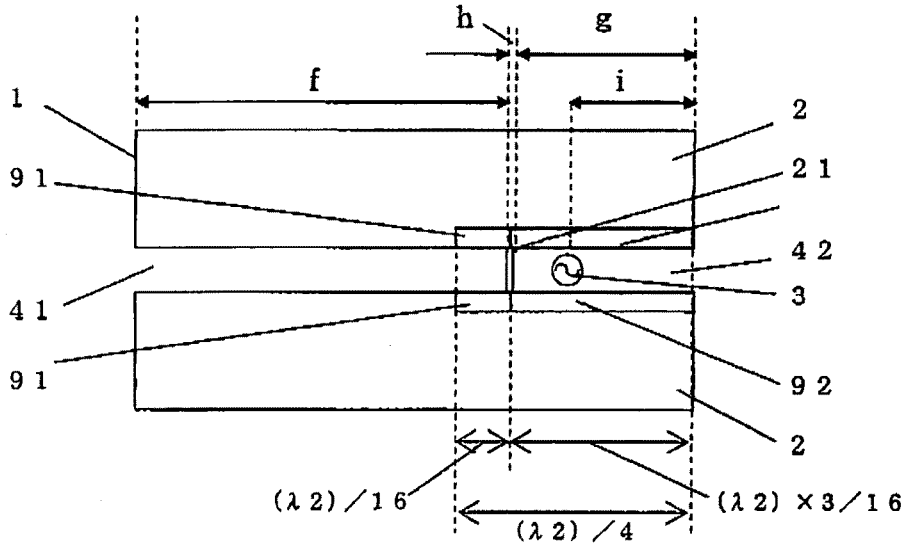
FIG. 3 is an explanatory diagram showing an operation principle of the antenna in the first embodiment according to the present invention.

According to the structure as shown in FIG. 1, in the first designed frequency defining the wavelength $\lambda 1$, when an electric current, which has this frequency component and is generated on the conductor plate 2 constituting the antenna 1 from the feeding point 3, is distributed in the vicinity of an opposing conductor edges of the first rectangular slot 41 having the length f of $(\lambda 1)\times 3/16$ in accordance with resonance operation, the electric current is converged into the slot boundary conductor part 21 as shown in FIG. 2, so that a virtual feeding point 31 is formed on the slot boundary conductor part 21. At this time, an electric current distribution 91 for $(\lambda 1)\times 3/16$ occurs in the vicinity of opposing conductor edges 41*b*, 41*c* of the first rectangular slot 41 having the length f, and an electric current distribution 92 for $(\lambda 2)\times 1/16$ occurs in the vicinity of opposing conductor edge 42*b*, 42*c* of the second rectangular slot 42 having the length g, with respect to the virtual feeding point 31 as the boundary. Finally, a slot antenna which operates at a wavelength of $(\lambda 1)\times 4/16(=(\lambda 1)/4)$ is realized.

On the other hand, in the second designed frequency defining the wavelength $\lambda 2$, when an electric current having this frequency component and generated on the conductor plate 2 constituting the antenna 1 from the feeding point 3 is distributed in the vicinity of an opposing conductor edge of the second rectangular slot 42 having the length g of $(\lambda 2)\times 3/16$ in accordance with resonance operation, the presence of the slot boundary conductor part 21 is not electrically recognized. As shown in FIG. 3, the width h of the slot boundary conductor part 21 is shorter enough than the length g of the second rectangular slot 42, i.e. smaller enough than the wavelength $\lambda 2$. The width h of the slot boundary conductor part 21 is preferably smaller than 1/10 of the wavelength $\lambda 2$. At this time, the electric current distribution 92 for $(\lambda 2)\times 3/16$ occurs in the vicinity of the opposing conductor edges 42*b*, 42*c* of the second rectangular slot 42 having the length g, and the electric current distribution 91 for $(\lambda 2)\times 1/16$ occurs in the vicinity of the opposing conductor edges 41*b*, 41*c* of the first rectangular slot 41 having the length f. Finally, the slot antenna which operates at a wavelength of $(\lambda 2)\times 4/16(=(\lambda 2)/4)$ is realized.

As described above, in the antenna of the present invention, two slot antennas respectively operating at $(\lambda 1)/4$ and $(\lambda 2)/4$ with respect to the slot boundary conductor part 21 as the boundary can be arranged in the opposite directions in the same plane. Therefore, it is possible to realize the antenna which transmits and receives the electric wave comprising the particular polarization component particular to the slot antenna in the two frequency bands different from each other.

First Embodiment

Next, the antenna 1 in the first embodiment will be explained below in more detail, with referring to FIGS. 4 to 6.

Figure 4:
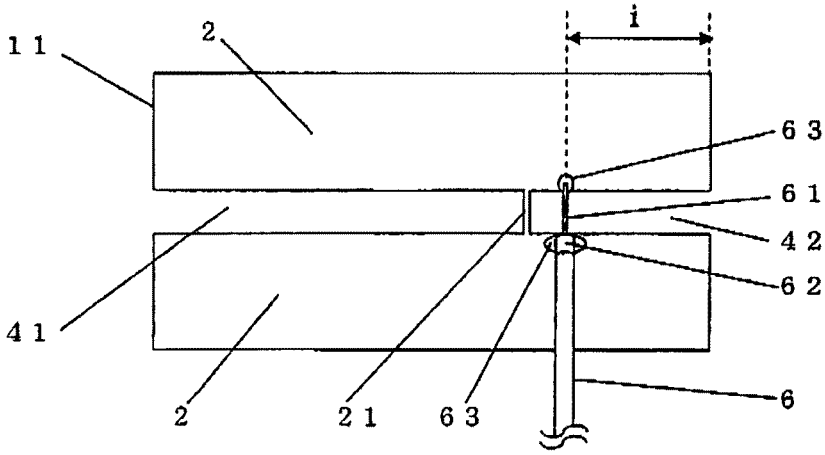
FIG. 4 is an explanatory diagram showing the structure of the antenna in the first embodiment according to the present invention.

FIG. 4 is an explanatory diagram showing the structure of an antenna 11 in a variation of the first embodiment according to the present invention.

Referring to FIG. 4, the antenna 11 comprises a coaxial cable 6 for power feeding in the antenna 1 of FIG. 1. The coaxial cable 6 comprises an inner conductor 61 and an outer conductor 62. At a position distant from the opened edge 42*a* with the distance i, the inner conductor 61 of the coaxial cable 6 is connected to one of the conductor edges 42*b*, 42*c* that are opposed to each other in parallel along the longitudinal direction of the second rectangular slot 42 with a conductive solder material 63, and the outer conductor 62 of the coaxial cable 6 is connected to the other of the conductor edges 42*b*, 42*c* with the conductive solder 63.

The connection of the feeding line such as the coaxial cable 6 to the antenna 11 may be carried out by connection using a specialized connector or stay which can keep the electrical conductivity, as well as fusion-connecting using the solder material having the electrical conductivity. The antenna 11 as shown in FIG. 4 is line symmetrical in a direction perpendicular to the longitudinal direction of the slot antenna, similarly to the antenna 1 of FIG. 1.

The antenna 11 of FIG. 4 employs a conductor plate having a thickness of 0.2 mm. The dimensions of the respective elements are determined in accordance with the definitions shown in FIG. 1, namely, a=102 mm, b=50 mm, c=21 mm, d=8 mm, e=8 mm, f=68 mm, g=33 mm, h≦1 mm, and i=27 mm. In order to provide the antenna 1 which operates in the two frequency bands of 860 MHz band and 1720 MHz band, the length f is determined as about 3/16 of the wavelength λ1 of the electric wave in the first designed frequency of 860 MHz (≈349 mm), and the length g is determined as about 3/16 of the wavelength λ2 of the electric wave at the second designed frequency of 1720 MHz (≈17 6 mm), and the distance i is determined for setting the position of the feeding point 3 such that the antenna 11 operates in the second designed frequency. The power feeding to the antenna 11 is provided by using a coaxial cable having an outer diameter of about 1.1 mm. A ferrite (not show) is installed in a part of the coaxial cable except a part overlapping the conductor part of the antenna 11, with considering the adverse effects to various characteristics. In the coaxial cable used in the following explanation of the antenna of the present invention, a ferrite is installed similarly to the first embodiment.

Figure 5:
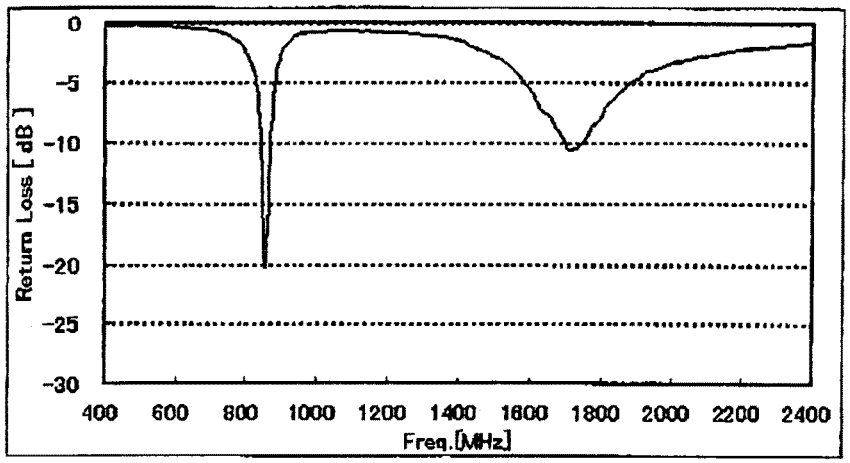
FIG. 5 is a graph showing frequency characteristics of the antenna in the first embodiment according to the present invention.

FIG. 5 is a graph showing frequency characteristics of the antenna 11 in the first embodiment according to the present invention, in which a horizontal axis indicates a frequency and a vertical axis indicates a return loss.

Referring to FIG. 5, the antenna 11 operates in 800 MHz band and 1700 MHz band that are the two frequency bands different from each other.

Figure 6A:
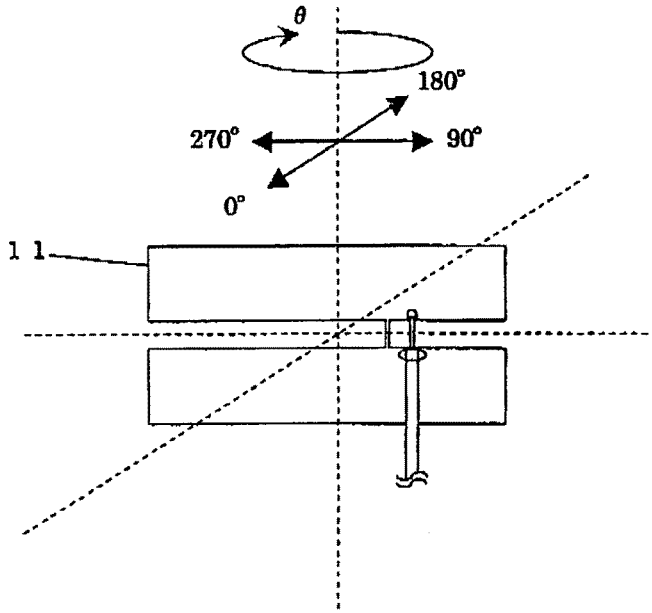
FIGS. 6A and 6B are diagrams showing radiated power distribution characteristics of the antenna in the first embodiment according to the present invention.
Figure 6B:
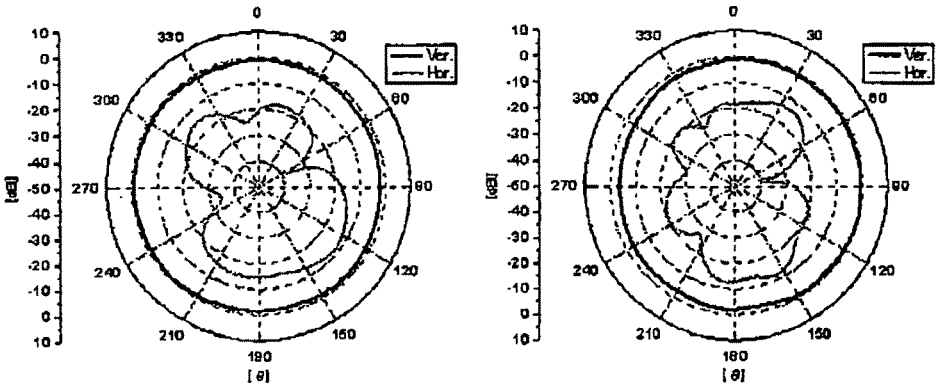

FIGS. 6A and 6B are diagrams showing radiated power distribution characteristics of the antenna 11 of FIG. 4 in a far-field.

FIG. 6A shows a measuring plane definition, and FIG. 6B shows the radiated power distribution characteristics in each of the two application frequency bands. In each graph of FIG. 6B, the radiated power distribution characteristics is separately shown as the vertical polarization (Ver.) and the horizontal polarization (Hor.). Referring to FIG. 6B, the antenna 11 exhibits an excellent directional characteristic by the vertical polarization (non-directional characteristics) in each frequency of the two frequency bands.

According to the results as shown in FIG. 5 and FIGS. 6A and 6B, according to the antenna of the present invention, it is possible to transmit and receive the electric wave comprising the particular polarization component in the two frequency bands different from each other, by using two antenna element structures for transmitting and receiving the electric wave comprising the particular polarization component, and providing the feeding point only in either one of the two antenna element structures.

Second Embodiment

Next, the antenna in the second embodiment according to the present invention will be described with referring to FIGS. 7 and 8.

Figure 7:
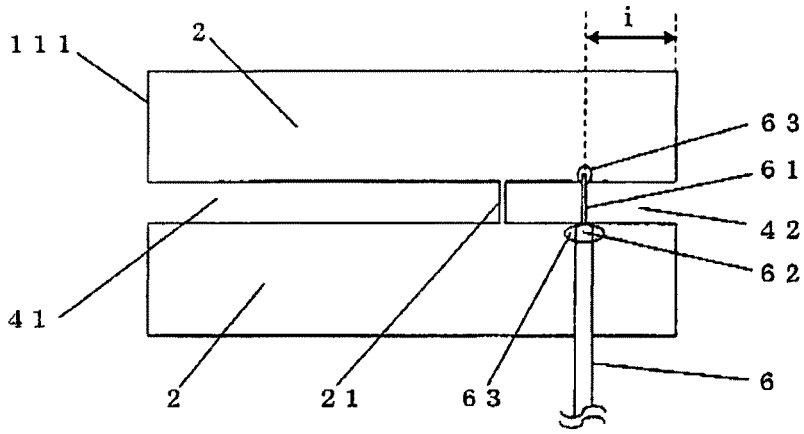
FIG. 7 is a diagram showing a structure of an antenna in the second embodiment according to the present invention.

FIG. 7 is a diagram showing a structure of an antenna 111 in the second embodiment according to the present invention.

The antenna 111 of FIG. 7 is similar to the antenna 11 of FIG. 4, except the distance i for defining the position of the feeding point 3 in the antenna 11 of FIG. 4 is changed to 12 mm in the antenna 111 of FIG. 7. In the antenna 111, the frequency band, in which the antenna 111 operates mainly using the second rectangular slot 42 provided with the feeding point 3, is changed by changing the distance i for defining the location of the feeding point 3. The antenna 111 operates in the two frequency bands, i.e. 800 MHz band and 2000 MHz band. In addition, the antenna 111 as shown in FIG. 7 is line-symmetrical in a direction perpendicular to a longitudinal direction of the slot antenna, similarly to the antenna 1 of FIG. 1.

Figure 8:
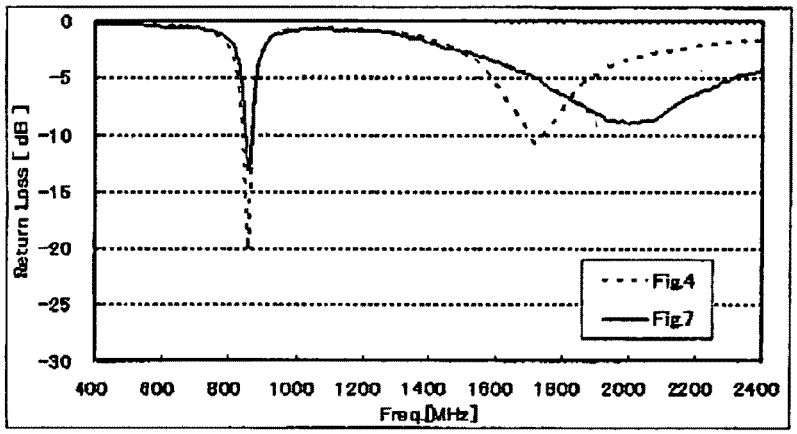
FIG. 8 is a graph showing frequency characteristics of the antenna in the second embodiment according to the present invention.

FIG. 8 is a graph showing frequency characteristics of the antenna 111 in the second embodiment according to the present invention.

FIG. 8 shows the frequency characteristics of the antenna 111 of FIG. 7 by a solid line, in which a horizontal axis indicates the frequency, and a vertical axis indicates the return loss. The measuring result of the antenna 11 of FIG. 4 is shown by a broken line.

Referring to FIG. 8, the antenna 111 exhibits the resonance characteristic in the two frequency bands, namely, in 800 MHz band in which the antenna 111 operates mainly using the first rectangular slot 41 provided with no feeding point 3, and in 2000 MHz band in which the antenna 111 operates mainly using the second rectangular slot 42 provided with the feeding point 3. Compared with the measuring result of the antenna 11 of FIG. 4, slight characteristic deterioration is observed in 800 MHz band. This characteristic deterioration is caused in accordance with deterioration of impedance matching in the virtual feeding point on the slot boundary conductor part 21, due to increase in the distance between the connecting position of the coaxial cable 6 as the feeding point and the slot boundary conductor part 21 compared with the antenna 11 of FIG. 4. In 2000 MHz band, it is observed that the return loss is increased to be greater than −10 dB in accordance with the deterioration of the impedance matching. Therefore, the adjustment of the impedance matching is necessary.

However, the antenna 111 in this embodiment realizes the resonance characteristic in the two frequency bands as target. In addition, as to the radiated power distribution characteristics of this time, the non-directional characteristic by the vertical polarization is provided in the two frequency bands, similarly to the antenna 11 of FIG. 6.

Third Embodiment

Next, the antenna in the third embodiment according to the invention will be described with referring to FIGS. 9 and 10.

Figure 9:
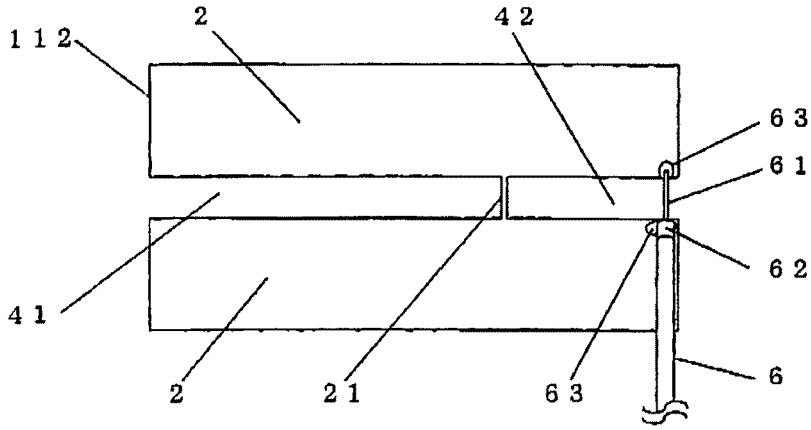
FIG. 9 is a diagram showing a structure of an antenna in the third embodiment according to the present invention.

FIG. 9 is a diagram showing a structure of an antenna 112 in the third embodiment according to the present invention.

The antenna 112 of FIG. 9 is similar to the antenna 11 of FIG. 4, except the distance i for defining the position of the feeding point 3 in the antenna 11 of FIG. 4 is changed to 0 mm in the antenna 112 of FIG. 9. In the antenna 112, the frequency band, in which the antenna 112 operates mainly using the second rectangular slot 42 provided with the feeding point 3, is changed by changing the distance i for defining the location of the feeding point 3. The antenna 112 operates in the two frequency bands, i.e. 800 MHz band and 2300 MHz band.

Figure 10:
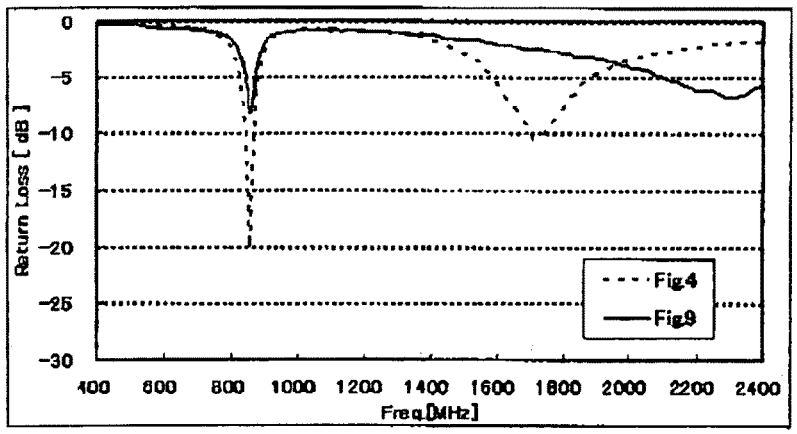
FIG. 10 is a graph showing frequency characteristics of the antenna in the third embodiment according to the present invention.

FIG. 10 is a graph showing frequency characteristics of the antenna 112 in the third embodiment according to the present invention.

FIG. 10 shows the frequency characteristics of the antenna 112 of FIG. 9 by a solid line, in which a horizontal axis indicates the frequency, and a vertical axis indicates the return loss. The measuring result of the antenna 11 of FIG. 4 is shown by a broken line.

Referring to FIG. 10, the antenna 112 exhibits the resonance characteristic in the two frequency bands, namely, in 800 MHz band in which the antenna 112 operates mainly using the first rectangular slot 41 provided with no feeding point 3, and in 2300 MHz band in which the antenna 112 operates mainly using the second rectangular slot 42 provided with the feeding point 3. Compared with the measuring result of the antenna 11 of FIG. 4, slight characteristic deterioration is observed in 800 MHz band. This characteristic deterioration is caused in accordance with deterioration of impedance matching in the virtual feeding point on the slot boundary conductor part 21, due to increase in the distance between the connecting position of the coaxial cable 6 as the feeding point and the slot boundary conductor part 21 compared with the antenna 11 of FIG. 4. In 2300 MHz band, it is observed that the return loss is increased to be greater than −10 dB in accordance with the deterioration of the impedance matching. Therefore, the adjustment of the impedance matching is necessary.

However, the antenna 112 in this embodiment realizes the resonance characteristic in the two frequency bands as target. In addition, as to the radiated power distribution characteristics of this time, the non-directional characteristic by the vertical polarization is provided in the two frequency bands, similarly to the antenna 11 of FIG. 6.

According to the results as shown in FIGS. 8 and 10, according to the antenna of the present invention, it is possible to transmit and receive the electric wave comprising the particular polarization component in the two frequency bands different from each other, by using two antenna element structures for transmitting and receiving the electric wave comprising the particular polarization component, providing the feeding point only in either one of the two antenna element structures, and adjusting the location of the feeding point to adjust the resonance characteristics in the two frequency bands different from each other.

Fourth Embodiment

Next, the antenna in the fourth embodiment according to the present invention will be described with referring to FIGS. 11 and 12.

Figure 11:
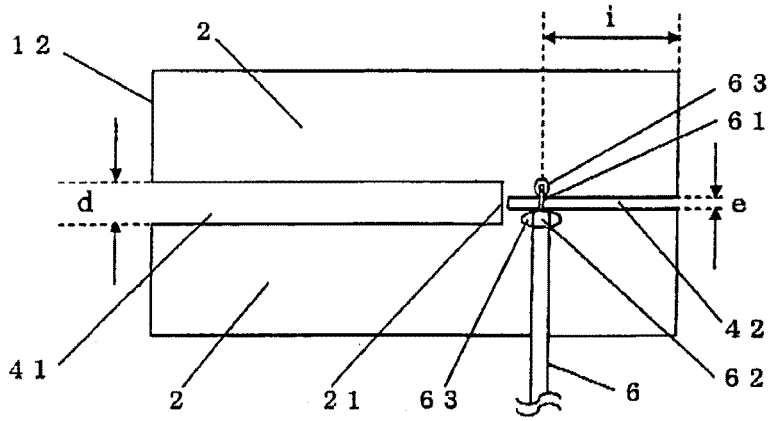
FIG. 11 is a diagram showing a structure of an antenna in the fourth embodiment according to the present invention.

FIG. 11 is a diagram showing a structure of an antenna 12 in the fourth embodiment according to the present invention.

The antenna 12 of FIG. 11 is similar to the antenna 11 of FIG. 4, except the width e of the second rectangular slot 42 provided with the feeding point 3 in the antenna 11 of FIG. 4 is changed to 2 mm. In the antenna 12, a capacitive property of the second rectangular slot 42 is adjusted by changing the width e of the second rectangular slot 42 provided with the feeding point 3, thereby changing the frequency band in which the antenna 12 operates mainly using the second rectangular slot 42 and the resonance characteristic thereof. The antenna 12 operates in the two frequency bands, i.e. 800 MHz band and 1900 MHz band. In addition, the antenna 12 as shown in FIG. 11 is line-symmetrical in a direction perpendicular to a longitudinal direction of the slot antenna, similarly to the antenna 1 of FIG. 1.

Figure 12:
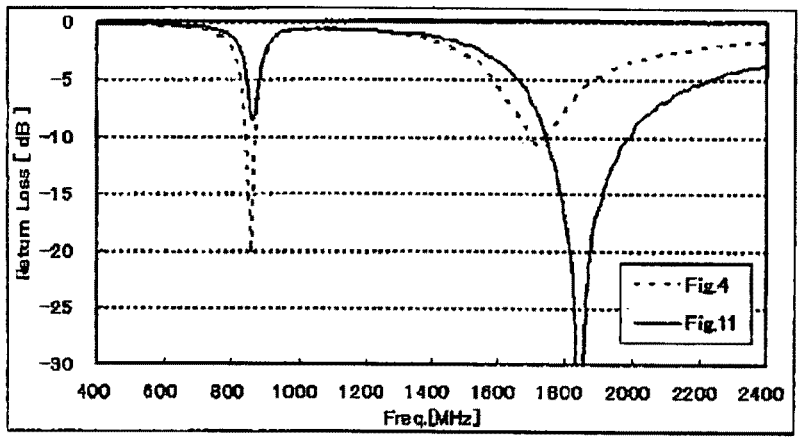
FIG. 12 is a graph showing frequency characteristics of the antenna in the fourth embodiment according to the present invention.

FIG. 12 is a graph showing frequency characteristics of the antenna 12 in the fourth embodiment according to the present invention.

FIG. 12 shows the frequency characteristics of the antenna 12 of FIG. 11 by a solid line, in which a horizontal axis indicates the frequency, and a vertical axis indicates the return loss. The measuring result of the antenna 11 of FIG. 4 is shown by a broken line.

Referring to FIG. 12, the antenna 12 exhibits the resonance characteristic in the two frequency bands, namely, in 800 MHz band in which the antenna 112 operates mainly using the first rectangular slot 41 provided with no feeding point 3, and in 1900 MHz band in which the antenna 112 operates mainly using the second rectangular slot 42 provided with the feeding point 3. Compared with the measuring result of the antenna 11 of FIG. 4, inn accordance with reduction in the width e of the second rectangular slot 42, complementary operation of the second rectangular slot 42 provided with the feeding point 3 to the first rectangular slot 41 provided with no feeding point is lost, so that characteristic deterioration is observed in 800 MHz band, and a tendency of a strong electrical capacitive property is observed in 1900 MHz band:

However, the antenna 12 in this embodiment realizes the resonance characteristic in the two frequency bands as target. In addition, as to the radiated power distribution characteristics of this time, the non-directional characteristic by the vertical polarization is provided in the two frequency bands, similarly to the antenna 11 of FIG. 6.

Fifth Embodiment

Next, the antenna in the fifth embodiment according to the invention will be described with referring to FIGS. 13 to 15.

Figure 13:
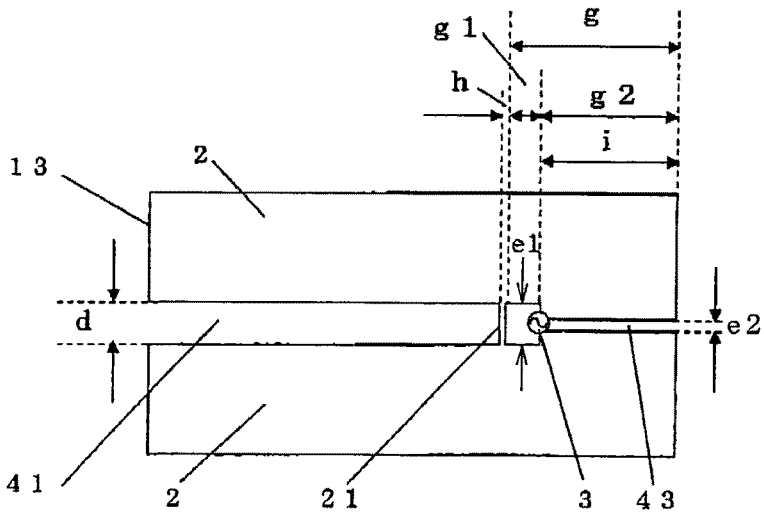
FIG. 13 is an explanatory diagram showing a structure of an antenna in the fifth embodiment according to the present invention.

FIG. 13 is an explanatory diagram showing a structure of an 13 antenna in the fifth embodiment according to the present invention.

The antenna 13 of FIG. 13 is directed to an improvement of the frequency characteristics (FIG. 12) of the antenna 12 of FIG. 11. The antenna 13 comprises the first rectangular slot 41 and a polygonal slot 43. In the polygonal slot 43, the length g of the second rectangular slot 42 provided with the feeding point 3 of antenna 12 of FIG. 11 for is divided into a length g1 and a length g2 (g=g1+g2) with respect to the location of the feeding point 3 determined by the distance i from the opened end 42*a* of the second rectangular slot 42. In the polygonal slot 43, a width e1 of a part within a range corresponding to the length g1 on a side of the slot boundary conductor part 21 is set to be equal to the width d of the first rectangular slot 41 provided with no feeding point, and a width e2 of a part within a range corresponding to the length g2 is same as the width e of the second rectangular slot 42 of the antenna 11 of FIG. 11. In other words, the polygonal slot 43 comprises two widths, i.e. the width d and the width e along a longitudinal direction of the polygonal slot 43. The antenna 13 operates in the two frequency bands, i.e. 800 MHz band and 1900 MHz band similarly to the antenna 12 of FIG. 11. In addition, the antenna 13 as shown in FIG. 13 is line-symmetrical in a direction perpendicular to a longitudinal direction of the slot antenna, similarly to the antenna 1 of FIG. 1.

Figure 14:
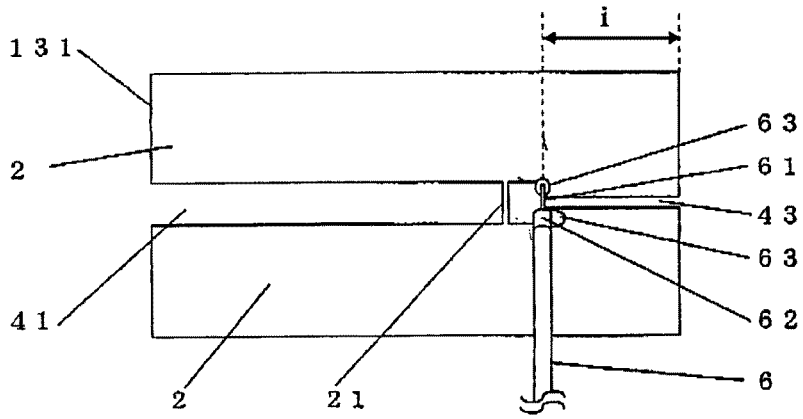
FIG. 14 is a diagram showing a structure of the antenna in the fifth embodiment according to the present invention.

FIG. 14 is a diagram showing a structure of an antenna 131 in a variation of the fifth embodiment according to the present invention.

The antenna 131 comprises a coaxial cable 6 for power feeding in the antenna 13 of FIG. 13. A connecting method of the coaxial cable 6 is similar to that in the antenna 11 of FIG. 4. The antenna 131 comprises a conductor plate having a thickness of 0.2 mm. The dimensions of the respective elements are determined in accordance with the definitions shown in FIG. 1, namely, a=102 mm, b=50 mm, c=21 mm, d=8 mm, e1=8 mm, e2=2 mm, f=68 mm, g1=7 mm, g2=26 mm (g=g1+g2=33 mm), h=1 mm, and i=27 mm. Therefore, the dimensions of the respective elements are similar to those in the antenna 11 of FIG. 4, except g1, g2, e1 and e2.

Figure 15:
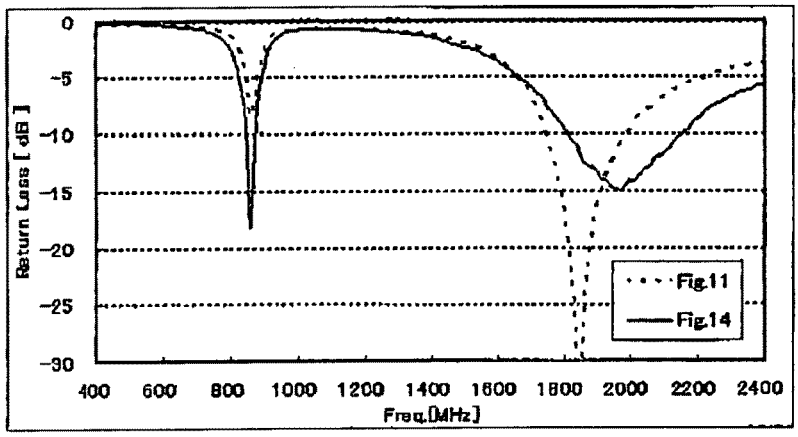
FIG. 15 is a graph showing frequency characteristics of the antenna in the fifth embodiment according to the present invention.

FIG. 15 is a graph showing frequency characteristics of the antenna 131 in the fifth embodiment according to the present invention.

FIG. 15 shows the frequency characteristics of the antenna 131 of FIG. 14 by a solid line, in which a horizontal axis indicates the frequency, and a vertical axis indicates the return loss. The measuring result of the antenna 12 of FIG. 11 is shown by a broken line.

Referring to FIG. 15, the antenna 131 exhibits the excellent resonance characteristic in the two frequency bands, namely, in 800 MHz band in which the antenna 131 operates mainly using the first rectangular slot 41 provided with no feeding point, and in 1900 MHz band in which the antenna 131 operates mainly using the polygonal slot 43 provided with the feeding point 3. Compared with the measuring result of the antenna 12 of FIG. 11, because of the shape of the polygonal slot 43, the complementary operation of the polygonal slot 43 to the first rectangular slot 41 provided with no feeding point is maintained, so that characteristic enhancement is observed in 800 MHz band. Further, the electrical capacitive property is appropriately maintained, so that the characteristic enhancement is observed in 1900 MHz band. In addition, as to the radiated power distribution characteristics of this time, the excellent non-directional characteristic by the vertical polarization is provided in the two frequency bands, similarly to the antenna 11 of FIG. 6.

According to the results as shown in FIGS. 12 and 15, in the antenna of the present invention, it is possible to transmit and receive the electric wave comprising the particular polarization component in the two frequency bands different from each other, by using two antenna element structures for transmitting and receiving the electric wave comprising the particular polarization component, providing the feeding point only in either one of the two antenna element structures, and adjusting the dimensions of the respective antenna element structures to adjust the resonance characteristics of the electric wave comprising the particular polarization component in the two frequency bands different from each other.

Sixth Embodiment

Next, the antenna in the sixth embodiment according to the present invention will be described with referring to FIGS. 16 and 17.

Figure 16:
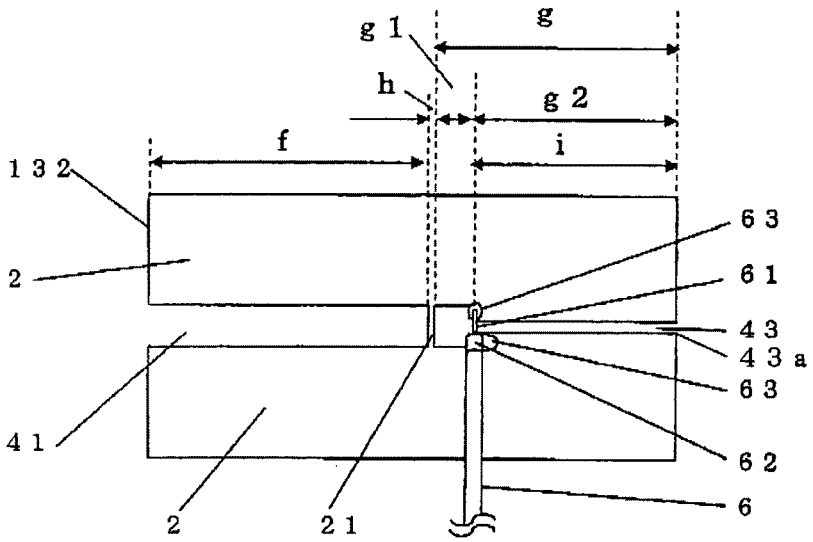
FIG. 16 is a diagram showing a structure of an antenna in the sixth embodiment according to the present invention.

FIG. 16 is a diagram showing a structure of an antenna 132 in the sixth embodiment according to the present invention.

The antenna 132 of FIG. 16 is similar to the antenna 131 of FIG. 14, except that the length f of the first rectangular slot 41 provided with no feeding point is changed to 54 mm, the partial length g2 of the polygonal slot 43 is changed to 40 mm (g=g1+g2=7 mm+40 mm=47 mm), and the location of the feeding point 3 defined by the distance i from an opened end 43*a* of the polygonal slot 43 is 40 mm, respectively.

In order to provide the antenna 132 which operates in the two frequency bands of 1000 MHz band and 1400 MHz band, the length f is determined as about 3/16 of the wavelength λ1 of the electric wave in the first designed frequency of 1000 MHz (≈300 mm), and the length g is determined as about 3/16 of the wavelength λ2 of the electric wave at the second designed frequency of 1400 MHz (≈214 mm), and the distance i is determined for setting the position of the feeding point 3 such that the antenna 132 operates in the second designed frequency. The antenna 132 of FIG. 16 is line-symmetrical in the direction perpendicular to the longitudinal direction of the slot antenna, similarly to the antenna 1 of FIG. 1.

Figure 17:
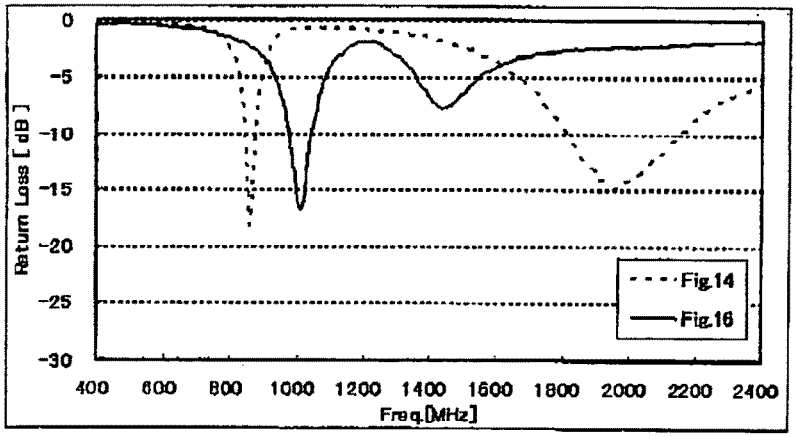
FIG. 17 is a graph showing frequency characteristics of the antenna in the sixth embodiment according to the present invention.

FIG. 17 is a graph showing frequency characteristics of the antenna 132 in the sixth embodiment according to the present invention.

FIG. 17 shows the frequency characteristics of the antenna 132 of FIG. 16 by a solid line, in which a horizontal axis indicates the frequency, and a vertical axis indicates the return loss. The measuring result of the antenna 131 of FIG. 14 is shown by a broken line.

Referring to FIG. 17, the antenna 132 exhibits the resonance characteristic in the two frequency bands, namely, in 1000 MHz band in which the antenna 132 operates mainly using the first rectangular slot 41 provided with no feeding point 3, and in 1400 MHz band in which the antenna 132 operates mainly using the polygonal slot 43 provided with the feeding point 3. Compared with the measuring result of the antenna 131 of FIG. 14, the excellent characteristic are obtained in 1000 MHz band. In 1400 MHz band, it is observed that the adjustment of the impedance matching is necessary.

However, the antenna 132 in this embodiment realizes the resonance characteristic in the two frequency bands as target, and realizes the operation in adjacent frequency bands. In addition, as to the radiated power distribution characteristics of this time, the non-directional characteristic by the vertical polarization is provided in the two frequency bands, similarly to the antenna 11 of FIG. 6.

According to the results as shown in FIG. 17, in the antenna of the present invention, it is possible to transmit and receive the electric wave comprising the particular polarization component in the two frequency bands different from each other, by using two antenna element structures for transmitting and receiving the electric wave comprising the particular polarization component, providing the feeding point only in either one of the two antenna element structures, and adjusting the location of the feeding point and the dimensions of the antenna element structures to adjust the resonance characteristics in the two frequency bands different from each other.

Seventh Embodiment

Next, the antenna in the seventh embodiment according to the present invention according to the present invention will be described with referring to FIGS. 18 and 19.

Figure 18:
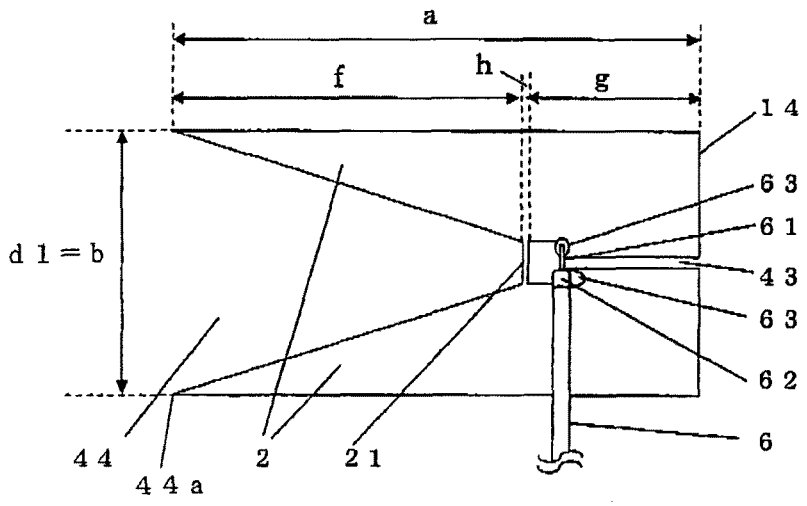
FIG. 18 is a diagram showing a structure of an antenna in the seventh embodiment according to the present invention.

FIG. 18 is a diagram showing a structure of an antenna in the seventh embodiment according to the present invention.

The antenna 14 of FIG. 18 is similar to the antenna 131 of FIG. 14, except that the first rectangular slot 41 provided with no feeding point is replaced with a fan-shaped slot 44 in which a width is slowly changed along a longitudinal direction of the slot. A width d1 at an opened end 44*a* of the fan-shaped slot 44 is 50 mm (=the width b of the conductor plate 2). The antenna 14 operates in two frequency bands, i.e. 800 MHz band and 1900 MHz band. In the antenna 14, the fan-shaped slot 44 is adopted for increasing a bandwidth of 800 MHz band in which the antenna 14 operates mainly by using the first rectangular slot 41 provided with no feeding point. In addition, the antenna 14 shown in FIG. 18 is line-symmetrical in a direction perpendicular to a longitudinal direction of the slot antenna similarly to the antenna 1 of FIG. 1.

Figure 19:
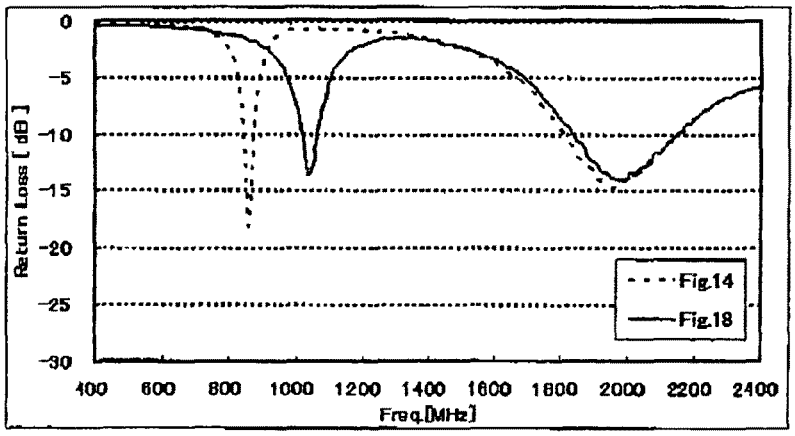
FIG. 19 is a graph showing frequency characteristics of the antenna in the seventh embodiment according to the present invention.

FIG. 19 is a graph showing frequency characteristics of the antenna in the seventh embodiment according to the present invention. FIG. 19 shows the frequency characteristics of the antenna 14 of FIG. 18 by a solid line, in which a horizontal axis indicates the frequency, and a vertical axis indicates the return loss. The measuring result of the antenna 131 of FIG. 14 is shown by a broken line.

Referring to FIG. 19, the antenna 14 exhibits the increase in the bandwidth of 800 MHz, namely the frequency band in which the antenna 14 operates mainly using the first rectangular slot 41 provided with no feeding point. However, it is different from the antenna 131 of FIG. 14 in that another frequency band (1900 MHz) is greatly shifted. It is assumed that balance of the electric capacitive property maintained by the rectangular slots (particularly by the first rectangular slot 41) is lost, and that matching with the polygonal slot 43 provided with the feeding point 3 is changed, so that the frequency bands in which the slots can operate is changed as a result. Even in this embodiment, as to the radiated power distribution characteristics, the non-directional characteristic by the vertical polarization is provided in the two frequency bands, similarly to the antenna 11 of FIG. 6.

Eighth Embodiment

Next, the antenna in the eighth embodiment according to the present invention according to the present invention will be described with referring to FIGS. 20 and 21.

Figure 20:
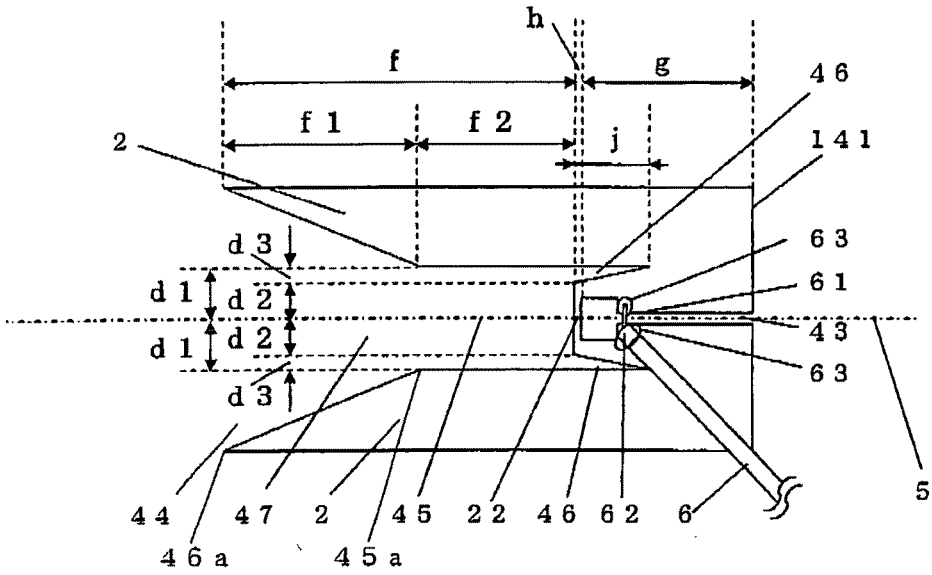
FIG. 20 is a diagram showing a structure of an antenna in the eighth embodiment according to the present invention.

FIG. 20 is a diagram showing a structure of an antenna 141 in the eighth embodiment according to the present invention.

The antenna 141 of FIG. 20 is directed to an improvement of the frequency characteristic (FIG. 19) of the antenna 14 of FIG. 18. In the antenna 141, the fan-shaped slot 44 of the antenna 14 of FIG. 18 is replaced with a complex type slot 47 shown in FIG. 20. The complex type slot 47 comprises a fan-shaped slot 44 having a width slowly changed along a longitudinal direction of the fan-shaped slot 44, a parallel slot 45 connected to the fan-shaped slot 44 and having a width which does not change along the longitudinal direction of the slot 45, two triangular slots 46 connected to the parallel slot 45 and each of which has a triangular shape. The two triangular slots 46 are formed to sandwich a part of the polygonal slot 43. The fan-shaped slot 44 and the parallel slot 45 of the complex type slot 47 have a length f1 and a length f2, respectively (f=f1+f2). The parallel slot 45 has the length f2 (f2=31 mm) from a point 45*a* which is distant from an opened end 46*a* by the length of 11 (f1=37 mm). Further, in the parallel slot 45, both of conductor edges are formed to be parallel with each other at a position distant by a distance d1 mm) from a boundary line 5 serving as a central axis for the line symmetry of the antenna 14. The triangular slot 46 is formed to have a right angle triangular shape, in which a length j in a longitudinal direction is 12 mm, and a length d3 (=d1−d2) in a shorter direction is 3 mm. This triangular slot 46 is directed to the adjustment of electric capacitive characteristics and the operation frequency in the slot. The complex type slot 47 comprises a slot boundary conductor part 22 has a width corresponding to 2 times of distance d2 (d2=7 mm, d1>d2) from the boundary line 5 showing the line symmetry of the antenna 141. As to the coaxial cable 6 for power feeding, an extending direction is selected not to intersect the triangular slot 46 as shown in FIG. 20. The antenna 141 shown in FIG. 20 is also line-symmetrical in the direction perpendicular to the longitudinal direction of the slot antenna, similarly to the antenna 1 of FIG. 1.

Figure 21:
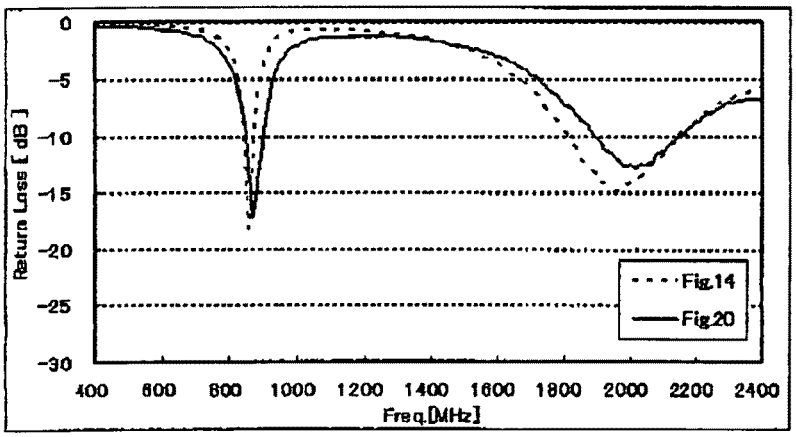
FIG. 21 is a graph showing frequency characteristics of the antenna in the eighth embodiment according to the present invention.

FIG. 21 is a graph showing frequency characteristics of the antenna 141 in the eighth embodiment according to the present invention.

FIG. 21 shows the frequency characteristics of the antenna 141 of FIG. 20 by a solid line, in which a horizontal axis indicates the frequency, and a vertical axis indicates the return loss. The measuring result of the antenna 131 of FIG. 14 is shown by a broken line.

Referring to FIG. 21, in the antenna 141, the shifting of the frequency band is improved compared with the antenna 14 of FIG. 18 (FIG. 19) because the of the shape of the complex type slot 47 provided with no feeding point. Compared with the antenna 131 of FIG. 14, the bandwidth of 800 MHz band in which the antenna 141 operates mainly using the complex type slot 47 provided with no feeding point is widened by the effect of the complex slot 47. Although the bandwidth of 1900 MHz band is slightly narrowed, the resonance characteristics in the two frequency bands as target are realized. In addition, as to the radiated power distribution characteristics of this time, the non-directional characteristic by the vertical polarization is provided in the two frequency bands, similarly to the antenna 11 of FIG. 6.

Ninth Embodiment

Figure 22:
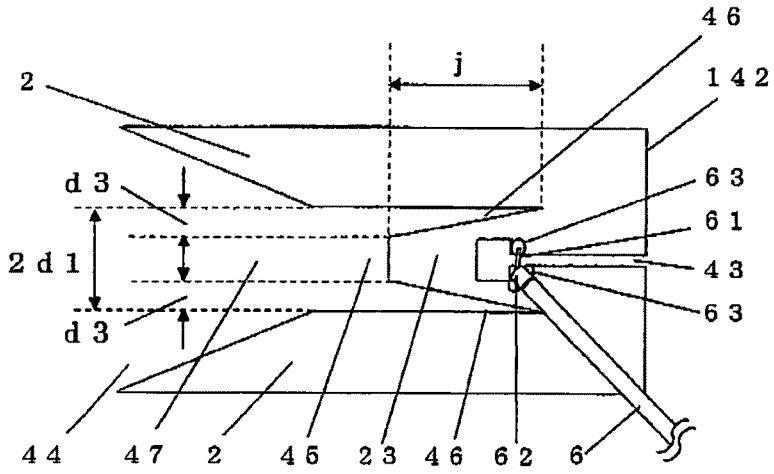
FIG. 22 is a diagram showing a structure of an antenna in the ninth embodiment according to the present invention.

FIG. 22 is a diagram showing a structure of an antenna 142 in the ninth embodiment according to the present invention.

The antenna 142 of FIG. 22 is directed to an improvement of the frequency characteristic (FIG. 21) of the antenna 141 of FIG. 20. In the antenna 142, the dimensions of the triangular slot 46 of the complex type slot 47 provided with no feeding point in the antenna 141 of FIG. 20 are changed, i.e. the length j=28 mm, the bottom length d3=6 mm. In accordance with this change, in the antenna 142, the slot boundary conductor part 22 of the antenna 141 of FIG. 20 is replaced with a slot boundary conductor part 23 shown in FIG. 22. Namely, the shape of the slot boundary conductor part 22 is changed into the shape of the slot boundary conductor part 23. As to the coaxial cable 6 for power feeding, an extending direction is selected not to intersect the triangular slot 46 as shown in FIG. 20. The antenna 142 shown in FIG. 22 is also line-symmetrical in the direction perpendicular to the longitudinal direction of the slot antenna, similarly to the antenna 1 of FIG. 1.

Figure 23:
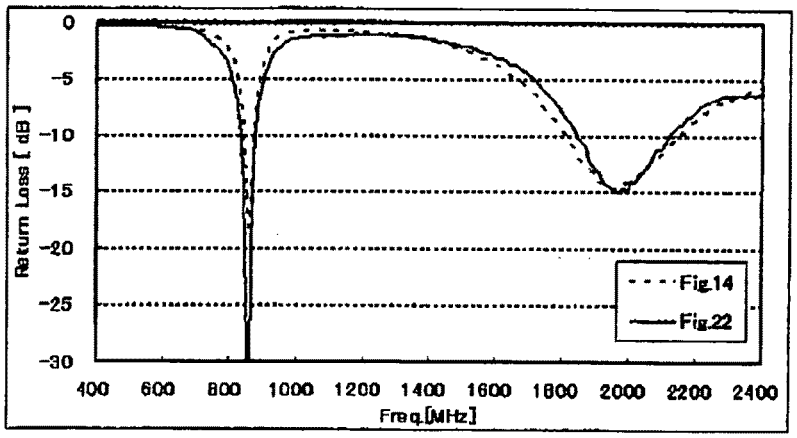
FIG. 23 is a graph showing frequency characteristics of the antenna in the ninth embodiment according to the present invention.

FIG. 23 is a graph showing frequency characteristics of the antenna 142 in the ninth embodiment according to the present invention.

FIG. 23 shows the frequency characteristics of the antenna 142 of FIG. 23 by a solid line, in which a horizontal axis indicates the frequency, and a vertical axis indicates the return loss. The measuring result of the antenna 131 of FIG. 14 is shown by a broken line.

Referring to FIG. 23, the antenna 142 exhibits the improvement in 1900 MHz band which is the narrow band in the antenna 141 of FIG. 20 (FIG. 21), because of the transformation of the complex type slot 47 provided with no feeding point. Compared with the result of the antenna 131 of FIG. 14, the resonance characteristic in 800 MHz band in which the antenna 142 operates mainly using the complex type slot 47 provided with no feeding point is improved and the wide bandwidth thereof is maintained, and the substantially same resonance characteristics in 1900 MHz band is maintained. In the antenna 142 of this embodiment, while a distance (length) between the polygonal slot 43 and the parallel slot 45 of the complex type slot 47 is increased, a distance (length) between the polygonal slot 43 and the triangular slot 46 of the complex type slot 47 is smaller enough than a wavelength of the electric wave in 1900 MHz band. Therefore, in the antenna 142, the resonance in each of the polygonal slot 43 and the complex type slot 47 can be realized by providing only one slot (the polygonal slot 43 in this embodiment) with the feeding point.

Figure 24A:
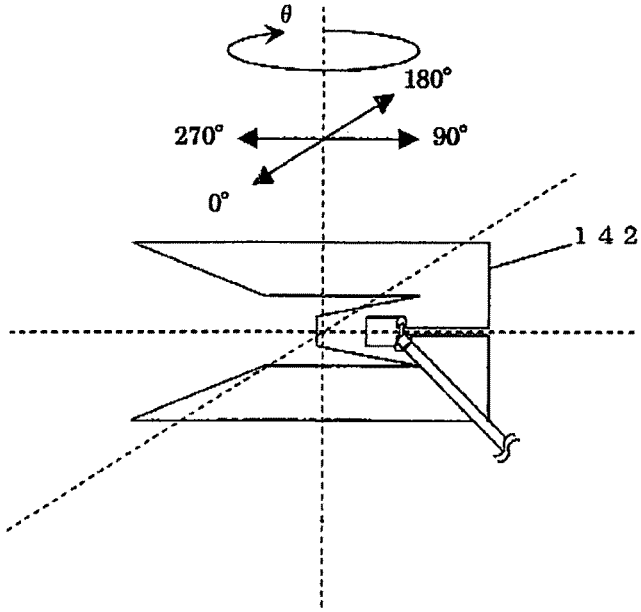
FIGS. 24A and 24B are diagrams showing radiated power distribution characteristics of the antenna in the ninth embodiment according to the present invention.
Figure 24B:
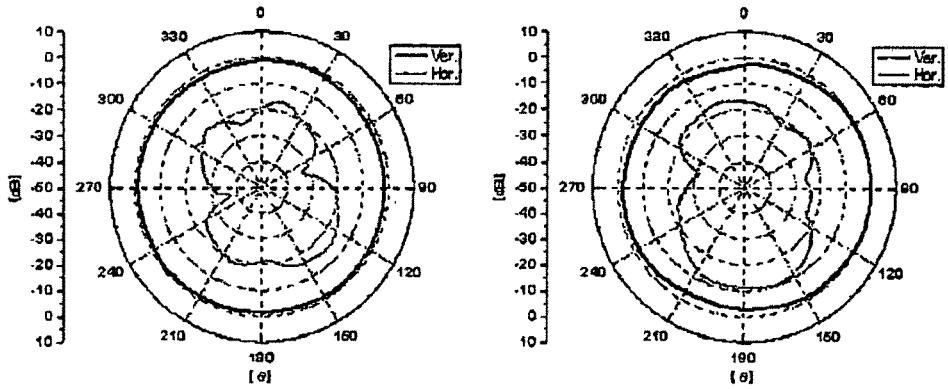

FIGS. 24A and 24B are diagrams showing radiated power distribution characteristics of the antenna 142 of FIG. 22 in a far-field. FIG. 24A shows a measuring plane definition, and FIG. 24B shows the radiated power distribution characteristics in each of the two application frequency bands. In each graph of FIG. 24B, the radiated power distribution characteristics is separately shown as the vertical polarization (Ver.) and the horizontal polarization (Hot). Referring to FIG. 24B, the antenna 142 exhibits an excellent directional characteristic by the vertical polarization (non-directional characteristics) in each frequency of the two frequency bands. The antenna 142 shown in FIG. 24A is also line-symmetrical in the direction perpendicular to the longitudinal direction of the slot antenna, similarly to the antenna 1 of FIG. 1.

According to the results as shown in FIGS. 19, 21, 23, 24A and 24B, in the antenna of the present invention, it is possible to transmit and receive the electric wave comprising the particular polarization component in the two frequency bands different from each other, by using two antenna element structures for transmitting and receiving the electric wave comprising the particular polarization component, providing the feeding point only in either one of the two antenna element structures, and adjusting the dimensions of the antenna element structures to adjust the resonance characteristics in the two frequency bands different from each other.

Tenth Embodiment

Next, an antenna in the tenth embodiment according to the present invention will be explained with referring to FIG. 25.

Figure 25:
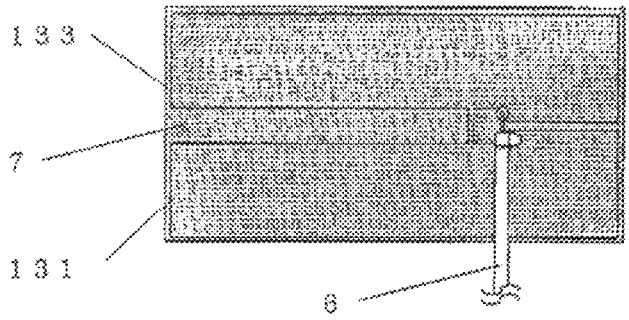
FIG. 25 is a diagram showing a structure of an antenna in the tenth embodiment according to the present invention.

FIG. 25 is a diagram showing a structure of an antenna 133 in the tenth embodiment according to the present invention.

The antenna 133 of FIG. 25 is formed by covering an entirety of the antenna 131 shown in FIG. 14 with an insulative sheet 7 such as laminate film. The insulative sheet 7 is removed (not shown) at a connecting part of the inner and outer conductors of the coaxial cable 6 for power feeding. In the antenna 133, dimensions of each part of the antenna 133 for each wavelength of each electric wave in the two frequency bands are reduced compared with the antenna 131 which is not covered with the insulative material, in consideration of an effect of a dielectric constant particular to an insulative material to the antenna 133.

Eleventh Embodiment

Next, an antenna in the eleventh embodiment according to the present invention will be explained with referring to FIG. 25.

Figure 26:
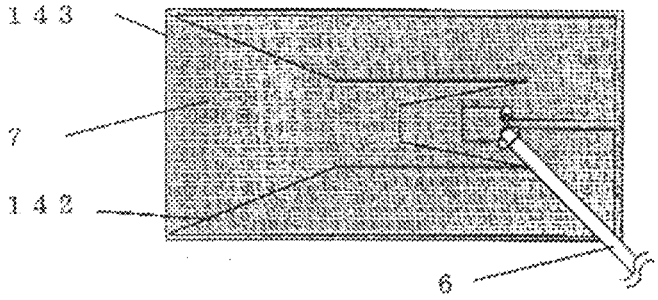
FIG. 26 is a diagram showing a structure of an antenna in the eleventh embodiment according to the present invention.

FIG. 26 is a diagram showing a structure of an antenna 143 in the eleventh embodiment according to the present invention.

The antenna 143 of FIG. 26 is formed by covering an entirety of the antenna 142 shown in FIG. 22 with an insulative sheet 7 such as laminate film. The insulative sheet 7 is removed (not Shown) at a connecting part of the inner and outer conductors of the coaxial cable 6 for power feeding. In the antenna 143, dimensions of each part of the antenna 143 for each wavelength of each electric wave in the two frequency bands are reduced compared with the antenna 142 which is not covered with the insulative material, in consideration of the effect of the dielectric constant particular to the insulative material to the antenna 143.

As shown in FIGS. 25 and 26, it is possible to easily obtain the configuration for preventing the antenna from being connected in high frequency with a conductor or the like of the outside, with the use of the insulative material. In addition, according to this feature, it is possible to easily maintain the characteristics of the antenna per se. For example, if the insulative material with relatively high hardness is employed, the shape of the antenna will be maintained easily. Therefore, according to the present invention, the versatility can be enhanced, and it is possible to realize an antenna which is excellent in transmission and reception of the electric wave comprising particular polarization component in the two frequency bands different form each other.

Next, antennas in the twelfth embodiment to the fifteenth embodiment according to the present invention will be explained with referring to FIGS. 27 to 30, respectively.

Twelfth Embodiment

Figure 27:
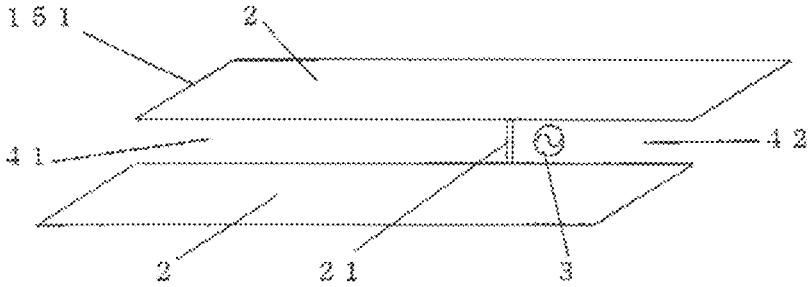
FIG. 27 is a diagram showing a structure of an antenna in the twelfth embodiment according to the present invention.

FIG. 27 is a diagram showing a structure of an antenna 151 in the twelfth embodiment according to the present invention.

The antenna 151 of FIG. 27 is formed by bending the antenna 11 of FIG. 4 (the coaxial cable 6 is not shown) in substantially Z-shape in backward and forward directions, at both ends of the slot boundary conductor part 21 as folding lines.

Thirteenth Embodiment

Figure 28:
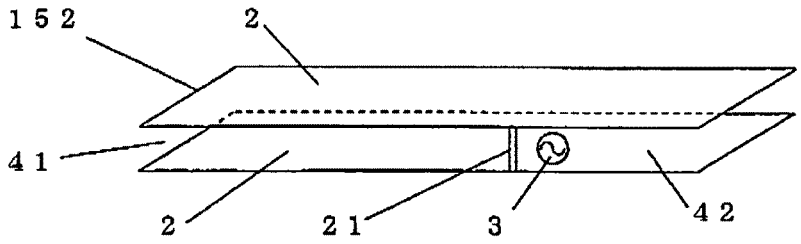
FIG. 28 is a diagram showing a structure of an antenna in the thirteenth embodiment according to the present invention.

FIG. 28 is a diagram showing a structure of an antenna 152 in the thirteenth embodiment according to the present invention.

The antenna 152 of FIG. 28 is formed by bending the antenna 11 of FIG. 4 (the coaxial cable 6 is not shown) in substantially U-shape (namely, one-side opened rectangular shape) in the same directions, at both ends of the slot boundary conductor part 21 as folding lines.

Fourteenth Embodiment

Figure 29:
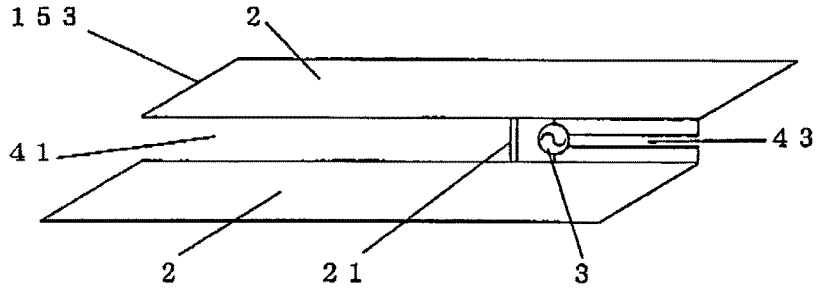
FIG. 29 is a diagram showing a structure of an antenna in the fourteenth embodiment according to the present invention.

FIG. 29 is a diagram showing a structure of an antenna 153 in the fourteenth embodiment according to the present invention.

The antenna 153 of FIG. 29 is formed by bending the antenna 131 of FIG. 14 (the coaxial cable 6 is not shown) in substantially Z-shape in backward and forward directions, at both ends of the slot boundary conductor part 21 as folding lines, and in vicinity of a part having the same width as the slot boundary conductor part 21 of the polygonal slot 43 provided with the feeding point 3 as folding lines.

Fifteenth Embodiment

Figure 30:
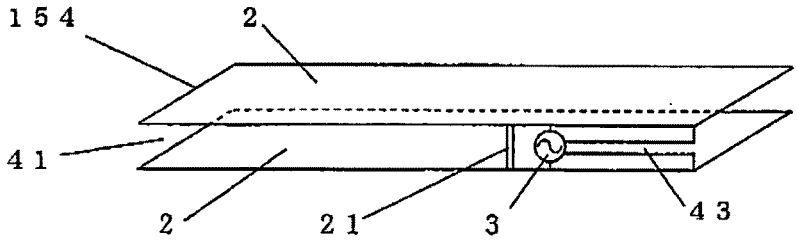
FIG. 30 is a diagram showing a structure of an antenna in the fifteenth embodiment according to the present invention.

FIG. 30 is a diagram showing a structure of an antenna 154 in the fifteenth embodiment according to the present invention.

The antenna 154 of FIG. 30 is formed by bending the antenna 131 of FIG. 14 (the coaxial cable 6 is not shown) in substantially U-shape (namely, one-side opened rectangular shape) in the same directions, at both ends of the slot boundary conductor part 21 as folding lines, and in vicinity of a part having the same width as the slot boundary conductor part 21 of the polygonal slot 43 provided with the feeding point 3 as folding lines.

The antenna structures shown in FIGS. 27 to 30 are examples of transforming the shape of the antenna three-dimensionally by partially bending the antenna. In these structures, the antenna of the present invention maintains the characteristics by keeping parallelism and shape of the opposed conductor edges of each slot, so that it is possible to realize the antenna which is excellent in transmission and reception of the electric wave comprising particular polarization component in the two frequency bands different from each other. Further, the antenna of the present invention can correspond to the shape and condition of the installation location of the antenna.

Herein, the folding lines in the antennas 151 to 154 are preferably parallel with the boundary line extending through a center of the width of the conductor plate 2. Further, the folding lines in the antennas 151 to 154 are preferably provided to be equidistant from the boundary line.

Next, antennas in the sixteenth embodiment to the nineteenth embodiment according to the present invention will be explained with referring to FIGS. 31 to 34, respectively.

Sixteenth Embodiment

Figure 31:
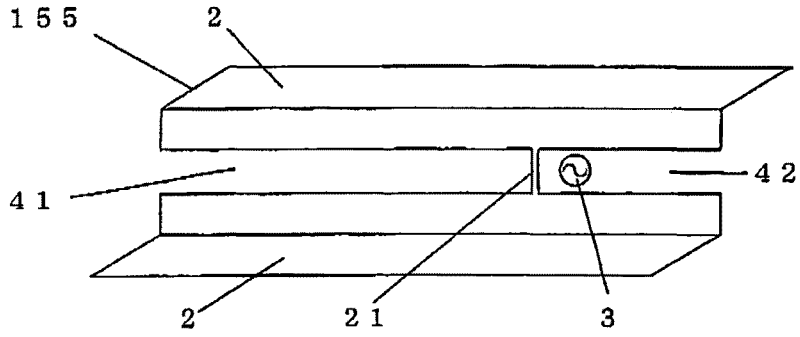
FIG. 31 is a diagram showing a structure of an antenna in the sixteenth embodiment according to the present invention.

FIG. 31 is a diagram showing a structure of an antenna 155 in the sixteenth embodiment according to the present invention.

The antenna 155 of FIG. 30 is formed by bending the antenna 11 of FIG. 4 (the coaxial cable 6 is not shown) in substantially Z-shape in backward and forward directions, in a mid-part of the conductor plate 2 composing each of the first and second rectangular slots 41, 42 as folding line. Namely, in the conductor plate 2, parts extending along both sides of the first and second rectangular slots 41, 42 are bent at folding lines that are parallel with the conductor edges of the first and second rectangular slots 41, 42 and that do not include the conductor edges of the first and second rectangular slots 41, 42.

Seventeenth Embodiment

Figure 32:
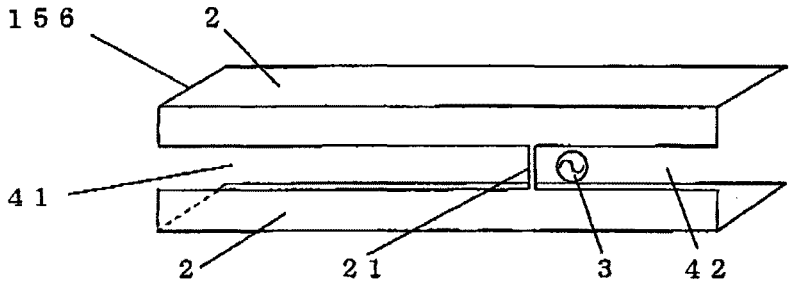
FIG. 32 is a diagram showing a structure of an antenna in the seventeenth embodiment according to the present invention.

FIG. 32 is a diagram showing a structure of an antenna 156 in the seventeenth embodiment according to the present invention;

The antenna 156 of FIG. 30 is formed by bending the antenna 11 of FIG. 4 (the coaxial cable 6 is not shown) in substantially U-shape (namely, one-side opened rectangular shape) in the same directions, in a mid-part of the conductor plate 2 composing each of the first and second rectangular slots 41, 42 as folding line, similarly to the sixteenth embodiment.

Eighteenth Embodiment

Figure 33:
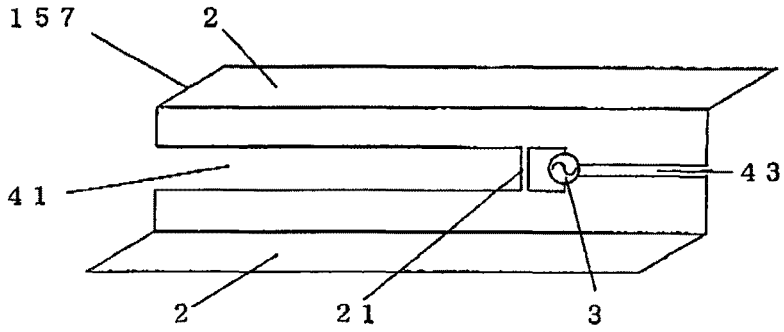
FIG. 33 is a diagram showing a structure of an antenna in the eighteenth embodiment according to the present invention.

FIG. 33 is a diagram showing a structure of an antenna 157 in the eighteenth embodiment according to the present invention.

The antenna 157 of FIG. 33 is formed by bending the antenna 131 of FIG. 14 (the coaxial cable 6 is not shown) in substantially Z-shape in backward and forward directions, in a mid-part of the conductor plate 2 composing each of the first rectangular slot 41 and the polygonal slot 43 as folding line, similarly to the sixteenth embodiment.

Nineteenth Embodiment

Figure 34:
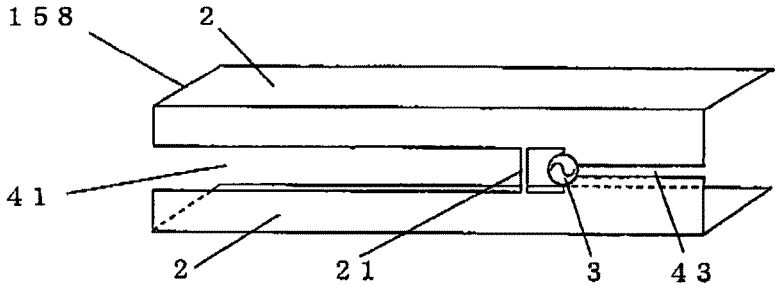
FIG. 34 is a diagram showing a structure of an antenna in the nineteenth embodiment according to the present invention.

FIG. 34 is a diagram showing a structure of an antenna 158 in the nineteenth embodiment according to the present invention.

The antenna 158 of FIG. 34 is formed by bending the antenna 131 of FIG. 14 (the coaxial cable 6 is not shown) in substantially U-shape (namely, one-side opened rectangular shape) in the same directions, in a mid-part of the conductor plate 2 composing each of the first rectangular slot 41 and the polygonal slot 43 as folding line, similarly to the sixteenth embodiment.

The antenna structures shown in FIGS. 31 to 34 are examples of transforming the shape of the antenna three-dimensionally by partially bending the antenna. In these structures, the antenna of the present invention maintains the characteristics by keeping parallelism and shape of the opposed conductor edges of each slot, so that it is possible to realize the antenna which is excellent in transmission and reception of the electric wave comprising particular polarization component in the two frequency bands different from each other. Further, the antenna of the present invention can correspond to the shape and condition of the installation location of the antenna.

Next, antennas in the twentieth embodiment to the twenty-third embodiment according to the present invention will be explained with referring to FIGS. 35 to 38, respectively.

Twentieth Embodiment

Figure 35:
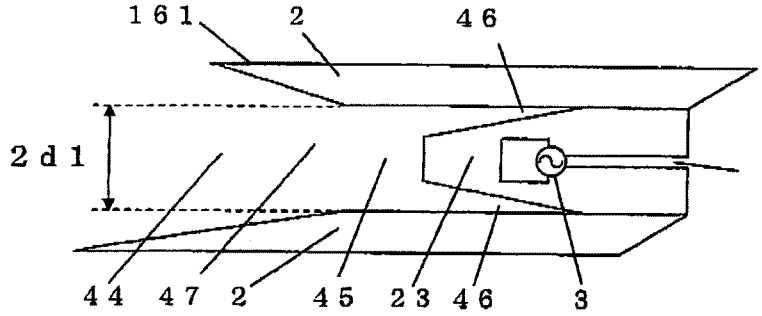
FIG. 35 is a diagram showing a structure of an antenna in the twentieth embodiment according to the present invention.

FIG. 35 is a diagram showing a structure of an antenna 161 in the twentieth embodiment according to the present invention;

The antenna 161 of FIG. 35 is formed by bending the antenna 142 of FIG. 22 (the coaxial cable 6 is not shown) in substantially Z-shape in backward and forward directions, at the conductor edges of the complex type slot 47 as folding line, while keeping the distance between the conductor edges facing to each other in the complex type slot 47.

Twenty-First Embodiment

Figure 36:
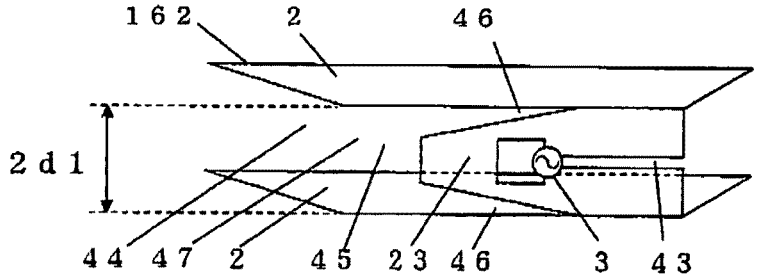
FIG. 36 is a diagram showing a structure of an antenna in the twenty-first embodiment according to the present invention.

FIG. 36 is a diagram showing a structure of an antenna 162 in the twenty-first embodiment according to the present invention.

The antenna 162 of FIG. 36 is formed by bending the antenna 142 of FIG. 22 (the coaxial cable 6 is not shown) in substantially U-shape (namely, one-side opened rectangular shape) in the same directions, at the conductor edges of the complex type slot 47 as folding lint, while keeping the distance between the conductor edges facing to each other in the complex type slot 47.

Twenty-Second Embodiment

Figure 37:
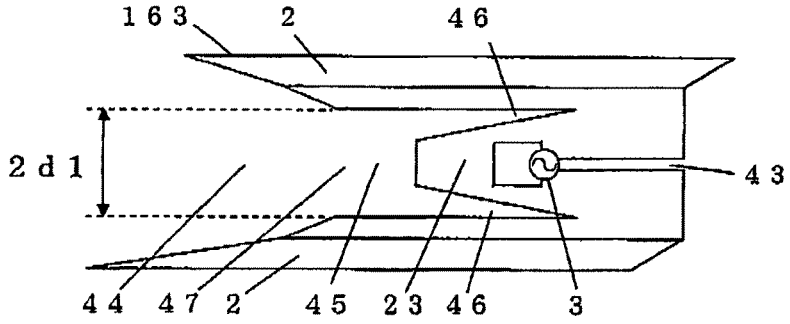
FIG. 37 is a diagram showing a structure of an antenna in the twenty-second embodiment according to the present invention.

FIG. 37 is a diagram showing a structure of an antenna 163 in the twenty-second embodiment according to the present invention.

The antenna 163 of FIG. 37 is formed by bending the antenna 142 of FIG. 22 (the coaxial cable 6 is not shown) in substantially Z-shape in backward and forward directions, in a mid-part of the conductor plate 2 composing each of the complex type slot 47 and the polygonal slot 43 as folding line. Namely, in the conductor plate 2, parts extending along both sides of the complex type slot 47 and the polygonal slot are bent at folding lines that are parallel with the conductor edges of the complex type slot 47 and the polygonal slot 43 and that do not include the conductor edges of the complex type slot 47 and the polygonal slot 43.

Twenty-Third Embodiment

Figure 38:
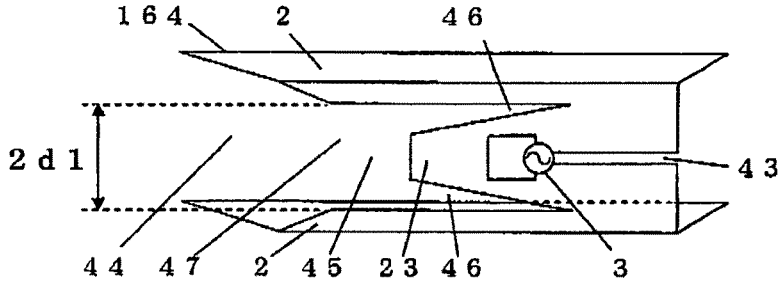
FIG. 38 is a diagram showing a structure of an antenna in the twenty-third embodiment according to the present invention.

FIG. 38 is a diagram showing a structure of an antenna 164 in the twenty-third embodiment according to the present invention.

The antenna 164 of FIG. 38 is formed by bending the antenna 142 of FIG. 22 (the coaxial cable 6 is not shown) in substantially U-shape (namely, one-side opened rectangular shape) in the same directions, in a mid-part of the conductor plate 2 composing each of the complex type slot 47 and the polygonal slot 43 as folding line.

The antenna structures shown in FIGS. 35 to 38 are examples of transforming the shape of the antenna three-dimensionally by partially bending the antenna in accordance with the shape and condition of the installation location of the antenna. In these structures, the antenna of the present invention maintains the characteristics by keeping parallelism and shape of the opposed conductor edges of each slot, so that it is possible to realize the antenna which is excellent in transmission and reception of the electric wave comprising particular polarization component in the two frequency bands different from each other.

Next, antennas in the twenty-fourth embodiment and the twenty-fifth embodiment according to the present invention will be explained with referring to FIGS. 39 and 40, respectively.

Twenty-Fourth Embodiment

Figure 39:
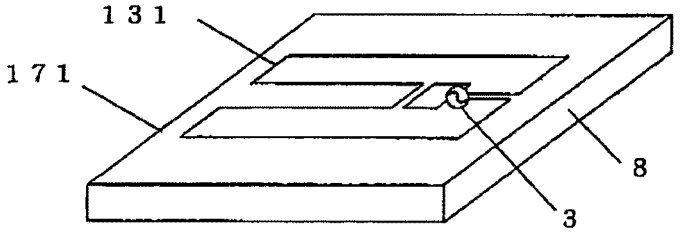
FIG. 39 is a diagram showing a structure of an antenna in the twenty-fourth embodiment according to the present invention.

FIG. 39 is a diagram showing a structure of an antenna 171 in the twenty-fourth embodiment according to the present invention.

The antenna 171 of FIG. 39 comprises the antenna 131 shown in FIG. 14 formed on a dielectric plate 8. In the antenna 171, dimensions of each part of the antenna 171 for each wavelength of each electric wave in the two frequency bands are reduced compared with the antenna 131 which is not formed on the dielectric plate 8, in consideration of the effect of the dielectric constant particular to the dielectric plate 8 to the antenna 171.

Twenty-Fifth Embodiment

Figure 40:
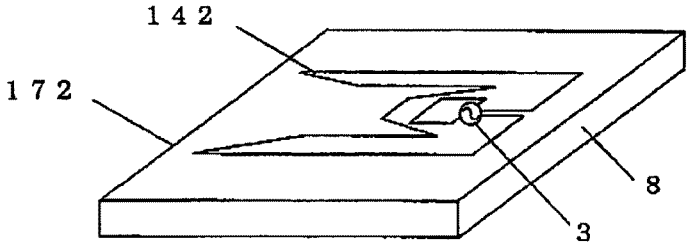
FIG. 40 is a diagram showing a structure of an antenna in the twenty-fifth embodiment according to the present invention.

FIG. 40 is a diagram showing a structure of an antenna 172 in the twenty-fifth embodiment according to the present invention. The antenna 172 of FIG. 40 comprises the antenna 142 shown in FIG. 22 formed on a dielectric plate 8. In the antenna 172, dimensions of each part of the antenna 172 for each wavelength of each electric wave in the two frequency bands are reduced compared with the antenna 142 which is not formed on the dielectric plate 8, in consideration of the effect of the dielectric constant particular to the dielectric plate 8 to the antenna 172.

The antenna 171 of FIG. 39 and the antenna 172 of FIG. 40 may be manufactured by attaching a conductor on the dielectric plate 8 or applying a plating material comprising a conductive material to the dielectric plate 8. The antenna 171 and the antenna 172 can be configured more easily on a circuit board. Further, it is possible to easily incorporate the antenna 171 or the antenna 172 in a device casing, by utilizing a power feeding structure (not shown) which is formed by processing the dielectric plate 8 separately. As the dielectric plate 8, a substrate having a conductor plane on one side or a substrate having conductor planes on both sides may be used.

Next, antennas in the twenty-sixth embodiment to the thirty-first embodiment according to the present invention will be explained with referring to FIGS. 41 and 46, respectively.

Twenty-Sixth Embodiment

Figure 41:
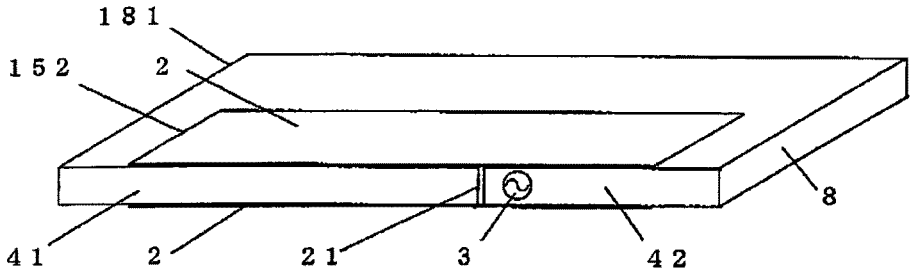
FIG. 41 is a diagram showing a structure of an antenna in the twenty-sixth embodiment according to the Present invention.

FIG. 41 is a diagram showing a structure of an antenna 181 in the twenty-sixth embodiment according to the present invention.

The antenna 181 of FIG. 41 comprises the antenna 152 of FIG. 28 using top and bottom surfaces and a side surface of the dielectric plate 8. In other words, the parts extending along the both sides of the first and second rectangular slots 41, 42 are provided on the top and bottom surface of the dielectric plate 8 to sandwich the dielectric plate 8, and the slot boundary conductor part 21 is provided on the side surface of the dielectric plate 8. A thickness of the dielectric plate 8 is substantially same as the widths of the first and second rectangular slots 41, 42. In the antenna 181, dimensions of each part of the antenna 181 for each wavelength of each electric wave in the two frequency bands are reduced compared with the antenna 152 which is not formed on the dielectric plate 8, in consideration of the effect of the dielectric constant particular to the dielectric plate 8 to the antenna 181.

Twenty-Seventh Embodiment

Figure 42:
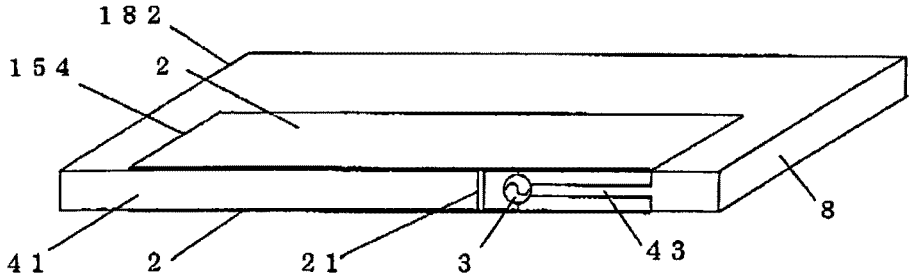
FIG. 42 is a diagram showing a structure of an antenna in the twenty-seventh embodiment according to the present invention.

FIG. 42 is a diagram showing a structure of an antenna 182 in the twenty-seventh embodiment according to the present invention.

The antenna 182 of FIG. 42 comprises the antenna 154 of FIG. 30 using top and bottom surfaces and a side surface of the dielectric plate 8. In other words, the parts extending along the both sides of the first rectangular slot 41 and the polygonal slot 43 are provided on the top and bottom surface of the dielectric plate 8 to sandwich the dielectric plate 8, and the slot boundary conductor part 21 and a part of the polygonal slot 43 are provided on the side surface. A thickness of the dielectric plate 8 is substantially same as the width of the first rectangular slots 41. In the antenna 182, dimensions of each part of the antenna 182 for each wavelength of each electric wave in the two frequency bands are reduced compared with the antenna 154 which is not formed on the dielectric plate 8, in consideration of the effect of the dielectric constant particular to the dielectric plate 8 to the antenna 182.

Twenty-Eighth Embodiment

Figure 43:
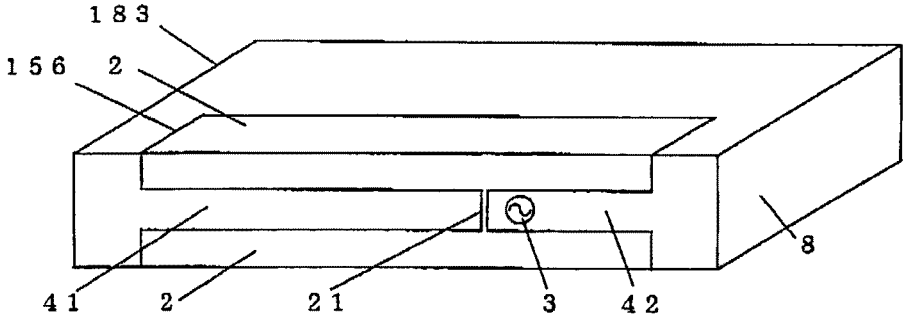
FIG. 43 is a diagram showing a structure of an antenna in the twenty-eighth embodiment according to the present invention.

FIG. 43 is a diagram showing a structure of an antenna 183 in the twenty-eighth embodiment according to the present invention.

The antenna 183 of FIG. 43 comprises the antenna 156 of FIG. 32 using top and bottom surfaces and a side surface of the dielectric plate 8. In other words, the parts extending along the both sides of the first and second rectangular slots 41, 42 are partially provided on the top and bottom surface of the dielectric plate 8 to sandwich the dielectric plate 8. The slot boundary conductor part 21 and the first and second rectangular slots 41, 42 are provided on the side surface of the dielectric plate 8. In the antenna 183, dimensions of each part of the antenna 183 for each wavelength of each electric wave in the two frequency bands are reduced compared with the antenna 156 which is not formed on the dielectric plate 8, in consideration of the effect of the dielectric constant particular to the dielectric plate 8 to the antenna 183.

Twenty-Ninth Embodiment

Figure 44:
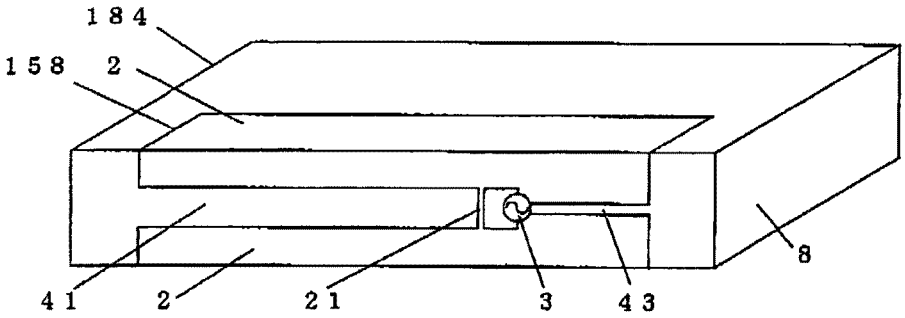
FIG. 44 is a diagram showing a structure of an antenna in the twenty-ninth embodiment according to the present invention.

FIG. 44 is a diagram showing a structure of an antenna 184 in the twenty-ninth embodiment according to the present invention.

The antenna 184 of FIG. 44 comprises the antenna 158 of FIG. 34 using top and bottom surfaces and a side surface of the dielectric plate 8. In other words, the parts extending along the both sides of the first rectangular slot 41 and the polygonal slot 43 are partially provided on the top and bottom surface of the dielectric plate 8 to sandwich the dielectric plate 8. The slot boundary conductor part 21, the first rectangular slot 41, and the polygonal slot 43 are provided on the side surface of the dielectric plate 8. In the antenna 184, dimensions of each part of the antenna 184 for each wavelength of each electric wave in the two frequency bands are reduced compared with the antenna 158 which is not formed on the dielectric plate 8, in consideration of the effect of the dielectric constant particular to the dielectric plate 8 to the antenna 184.

Thirtieth Embodiment

Figure 45:
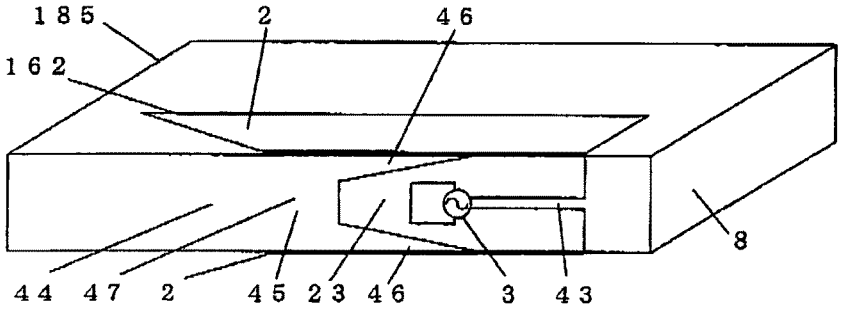
FIG. 45 is a diagram showing a structure of an antenna in the thirtieth embodiment according to the present invention.

FIG. 45 is a diagram showing a structure of an antenna 185 in the thirtieth embodiment according to the present invention.

The antenna 185 of FIG. 45 comprises the antenna 162 of FIG. 36 using top and bottom surfaces and a side surface of the dielectric plate 8. In other words, the parts extending along the both sides of the complex type slot 47 and the polygonal slot 43 are partially provided on the top and bottom surface of the dielectric plate 8 to sandwich the dielectric plate 8. A middle part of the fan-shaped slot 44, the parallel slot 45 and the rectangular slots 46 of the complex type slot 47 and the polygonal slot 43 are provided on the side surface. A thickness of the dielectric plate 8 is substantially same as the width of the parallel slot 45, namely, the conductor plate 2 is bent along the conductor edges of the parallel slot 45. In the antenna 185, dimensions of each part of the antenna 185 for each wavelength of each electric wave in the two frequency bands are reduced compared with the antenna 162 which is not formed on the dielectric plate 8, in consideration of the effect of the dielectric constant particular to the dielectric plate 8 to the antenna 185.

Thirty-First Embodiment

Figure 46:
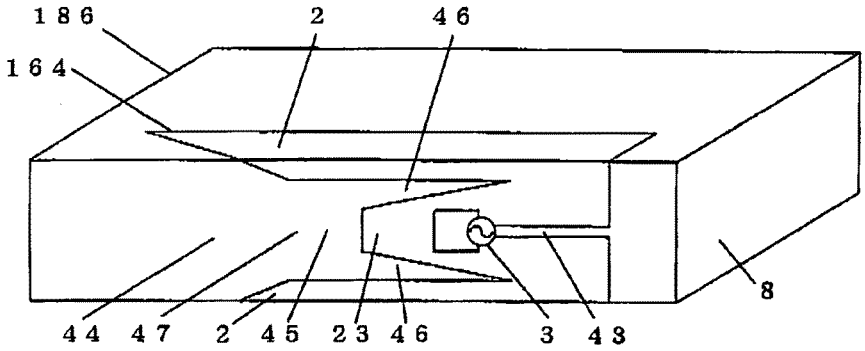
FIG. 46 is a diagram showing a structure of an antenna in the thirty-first embodiment according to the present invention.

FIG. 46 is a diagram showing a structure of an antenna 186 in the thirty-first embodiment according to the present invention.

The antenna 186 of FIG. 45 comprises the antenna 164 of FIG. 38 using top and bottom surfaces and a side surface of the dielectric plate 8. In other words, the parts extending along the both sides of the complex type slot 47 and the polygonal slot 43 are partially provided on the top and bottom surface of the dielectric plate 8 to sandwich the dielectric plate 8. A middle part of the fan-shaped slot 44, the parallel slot 45 and the rectangular slots 46 of the complex type slot 47 and the polygonal slot 43 are provided on the side surface. A thickness of the dielectric plate 8 is greater than the width of the parallel slot 45. In the antenna 186, dimensions of each part of the antenna 186 for each wavelength of each electric wave in the two frequency bands are reduced compared with the antenna 164 which is not formed on the dielectric plate 8, in consideration of the effect of the dielectric constant particular to the dielectric plate 8 to the antenna 186.

The antennas 181 to 186 of FIGS. 41 to 46 may be manufactured by attaching a conductor on the dielectric plate 8 or applying a plating material comprising a conductive material to the dielectric plate 8. The antennas 181 to 186 can be configured more easily on a circuit board. Further, it is possible to easily incorporate the antennas 181 to 186 in a device casing, by utilizing a power feeding structure (not shown) which is formed by processing the dielectric plate 8 separately. As the dielectric plate 8, a substrate having a conductor plane on one side or a substrate having conductor planes on both sides may be used.

As described above, it is possible to transmit and receive the electric wave comprising the particular polarization component in the two frequency bands different from each other, by using two antenna element structures for transmitting and receiving the electric wave comprising the particular polarization component, providing the feeding point only in either one of the two antenna element structures, and adjusting the dimensions of the antenna element structures, adjusting the location of the feeding point, or adjusting both of the antenna element structure dimensions and the feeding point location, to adjust the resonance characteristics in the two frequency bands different from each other.

According to the present invention, since the antenna per se has a simple structure, it is possible to easily manufacture the antenna of the present invention. In addition, since existing manufacturing technique and equipment can be utilized, it is possible to provide the antenna with excellent manufacturing yield which is low in cost and easy for handling.

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. An antenna for transmitting and receiving an electric wave in two different frequency bands, said antenna comprising:

a conductor;

a first slot and a second slot formed in the conductor to be facing to each other, an opened end of the first slot and an opened end of the second slot being formed on opposite sides of the conductor, respectively;

a boundary conductor provided between the first and second slots; and a feeding point, wherein a length of the second slot from the boundary conductor to the opened end of the second slot is shorter than a length of the first slot from the boundary conductor to the opened end of the first slot, wherein the feeding point is located only at the second slot, and wherein the length of the first slot is set based on a first wavelength of the electric wave in one of the frequency bands, and the length of the second slot is set based on a second wavelength of the electric wave in another one of the frequency bands.

2. The antenna according to claim 1, wherein respective areas of the first and second slots are different from each other.

3. The antenna according to claim 2, wherein a length of the boundary conductor is shorter than the lengths of the first and second slots.

4. The antenna according to claim 3, wherein the first and second slots are line-symmetrical with respect to a line passing through the first and second slots as a symmetrical axis.

5. The antenna according to claim 4, wherein at least one of the first and second slots comprises a rectangular slot.

6. The antenna according to claim 4, wherein at least one of the first and second slots comprises a polygonal slot having at least two different widths along a longitudinal direction of the polygonal slot.

7. The antenna according to claim 6, wherein the feeding point is formed in a vicinity of a portion in which a width of the polygonal slot is changed.

8. The antenna according to claim 7, wherein the first and second slots have a same width at a portion in which the first and second slots are facing to each other.

9. The antenna according to claim 4, wherein at least one of the first and second slots comprises a fan-shaped slot having a width which is gradually changed along a longitudinal direction of the fan-shaped slot.

10. The antenna according to claim 4, wherein at least one of the first and second slots comprises a complex type slot having a fan-shaped slot having a width which is gradually changed along a longitudinal direction of the complex type slot, a parallel slot connected to the fan-shaped slot and having a width which is constant along the longitudinal direction of the complex type slot, and two triangular slots connected to the parallel slot and each of which has a triangular shape.

11. The antenna according to claim 10, wherein the first and second slots are formed to sandwich a part of another of the first and second slots.

12. The antenna according to claim 4, wherein the antenna is bent at two straight lines parallel with the symmetrical axis as two folding lines.

13. The antenna according to claim 12, wherein the two folding lines are equidistant from the symmetrical axis.

14. An electric device, comprising:

a casing; and an antenna for transmitting and receiving an electric wave in two different frequency bands, formed in the casing, the antenna comprising:

a conductor;

a first slot and a second slot formed in the conductor to be facing to each other, an opened end of the first slot and an opened end of the second slot being formed on opposite sides of the conductor, respectively;

a boundary conductor provided between the first and second slots; and a feeding point, wherein a length of the second slot from the boundary conductor to the opened end of the second slot is shorter than a length of the first slot from the boundary conductor to the opened end of the first slot, wherein the feeding point is located only at the second slot, and wherein the length of the first slot is set based on a first wavelength of the electric wave in one of the frequency bands, and the length of the second slot is set based on a second wavelength of the electric wave in another one of the frequency bands.

15. The antenna according to claim 1, wherein the length of the first slot is set to be less than a quarter of the first wavelength of the electric wave in said one of the frequency bands.

16. The antenna according to claim 15, wherein the length of the second slot is set to be less than a quarter of the second wavelength of the electric wave in said another one of the frequency bands.

17. The antenna according to claim 1, wherein the length of the first slot is set to be 3/16 of the first wavelength of the electric wave in said one of the frequency bands, and wherein the length of the second slot is set to be 3/16 of the second wavelength of the electric wave in said another one of the frequency bands.

* * * * *